US007047707B2

(12) United States Patent
Lancaster, III et al.

(10) Patent No.: US 7,047,707 B2
(45) Date of Patent: May 23, 2006

(54) METHOD AND APPARATUS FOR SECURING A TAIL OF FILM TO A LOAD

(75) Inventors: Patrick R. Lancaster, III, Louisville, KY (US); Steven Hack, deceased, late of Fisherville, KY (US); by Laura Hack, legal representative, Taylorsville, KY (US)

(73) Assignee: Lantech.Com, LLC, Louisville, KY (US)

( * ) Notice: Subject to any disclaimer, the term of this patent is extended or adjusted under 35 U.S.C. 154(b) by 56 days.

(21) Appl. No.: 10/695,645

(22) Filed: Oct. 29, 2003

(65) Prior Publication Data

US 2004/0177592 A1 Sep. 16, 2004

Related U.S. Application Data

(60) Provisional application No. 60/422,878, filed on Nov. 1, 2002.

(51) Int. Cl.
*B65B 11/04* (2006.01)

(52) U.S. Cl. ..... 53/399; 53/441; 53/556; 53/587; 53/588

(58) Field of Classification Search ..... 53/399, 53/441, 465, 556, 587, 588, 211
See application file for complete search history.

(56) References Cited

U.S. PATENT DOCUMENTS 4,204,377 A * 5/1980 Lancaster et al. ..... 53/399
4,432,185 A 2/1984 Geisinger
4,619,102 A 10/1986 Geisinger
5,088,270 A * 2/1992 Diehl ..... 53/399
5,168,691 A * 12/1992 Errani ..... 53/587
5,450,711 A * 9/1995 Martin-Cocher ..... 53/556
5,564,258 A * 10/1996 Jones et al. ..... 53/399
5,802,810 A * 9/1998 Wojcik et al. ..... 53/399
5,941,049 A * 8/1999 Lancaster et al. ..... 53/399
6,269,610 B1 8/2001 Lancaster, III et al.
6,293,074 B1 9/2001 Lancaster, III et al.
6,453,643 B1 * 9/2002 Buscherini et al. ..... 53/399

* cited by examiner

*Primary Examiner*—Stephen F. Gerrity
(74) *Attorney, Agent, or Firm*—Finnegan, Henderson, Farabow, Garrett & Dunner, LLP

(57) ABSTRACT

A method and apparatus for securing an initial tail of film to a load while wrapping the load with packaging material are provided. The method includes holding a leading end of packaging material while providing relative rotation between the load and the dispenser to wrap film around the load. A portion of the leading end of film is secured to a fixed wrapping structure while the leading end of the film is held. After the leading end is secured to the fixed wrapping structure, the leading end of the film is released. The released leading end of the film is then secured to the load. The apparatus holds a leading end of packaging material and provides relative rotation between the load and a dispenser to dispense packaging material. The apparatus also secures a held leading end of packaging material and secures a released leading end of packaging material between two layers of packaging material. A method and apparatus for securing a final tail of film to the load also are provided.

53 Claims, 20 Drawing Sheets

METHOD AND APPARATUS FOR SECURING A TAIL OF FILM TO A LOAD

This application claims priority under 35 U.S.C. § 119 to U.S. Provisional Application No. 60/422,878, filed Nov. 1, 2002, the complete disclosure of which is incorporated herein by reference.

DESCRIPTION OF THE INVENTION

1. Field of the Invention

The present invention relates to a method and apparatus for wrapping a load with packaging material. More particularly, the present invention relates to a method and apparatus that minimizes the size of a film tail extending from the load after the load has been wrapped with film.

2. Background of the Invention

Loads have been stretch wrapped with stretch wrap packaging material by securing a leading end of the packaging material to the load or a clamp near a side of the load, dispensing the packaging material by providing relative rotation between the load and a packaging material dispenser to cause the load to be enveloped by the packaging material, and severing the packaging material between the load and a packaging material dispenser. The relative rotation between the load and the dispenser can be provided either by rotating the load on a turntable, or by translating the dispenser around a stationary load. Stretch wrapping usually employs a web of stretch film as the packaging material, and the machinery can be either automatic or semi-automatic.

At the end of the wrap cycle, a "tail" of film must be secured to the previously wrapped layers on the load. The tail can be the result of the initial or leading end of the film that was formed into at least a partial rope and held outside the film wrap by a film clamp until released at the end of the cycle. Additionally, tails may result from the trailing end of the film that is severed between the load and the dispenser at the end of the wrap cycle. If the tail is not secured, it may snag on forklift truck wheels, or be caught under adjacent loads during storage or transport, which may strip the load of the wrapping material. In addition, a long tail extending from the load can actuate photocells or motion sensors. A long tail extending from the load is also unsightly.

Most stretch wrapping depends on the tackiness of the film to secure the trailing end or "tail" of film to the previously wrapped layers on the load at the end of the wrapping cycle. The tackiness of the film can vary with the film's manufacturing variables, ambient temperature, humidity, dust, and the amount that the film has been stretched during the wrapping process. Other methods used to attach the tail to the wrapped load include heat sealers and "tucking" devices. The use of heat sealers has been problematic due to the unique environment required to seal film over varied surfaces, often without backing behind the film, and for many different types of packaging. Several tucking devices have been developed but are not used due to their lack of robustness or high equipment costs. Most tucking devices involve holding an inner layer of wrap away from the load while a rope of film is inserted behind the inner wrap.

SUMMARY OF THE INVENTION

The present invention is directed to an apparatus and a method for wrapping a load that wraps an initial tail of film against the wrapped load, thereby potentially providing advantages and obviating a number of problems in prior art devices and methods. The apparatus and method of the present invention may also minimize a final tail of film.

According to one aspect of the present invention, a method for wrapping a load with packaging material is provided. The method includes holding a leading end of a film web extending from a dispenser, providing relative rotation between the load and the dispenser to wrap the film web around the load, securing a portion of the leading end of the film web to a fixed wrapping structure prior to releasing the leading end of the film, releasing the leading end of the film web, and securing the released leading end of the film web to the load.

According to another aspect of the present invention, a method of securing an initial tail of packaging material to a load while wrapping the load with packaging material is provided. The method comprises holding a leading end of packaging material, wrapping the packaging material around a fixed wrapping structure, at least a portion of the leading end of the packaging material that is being held, and the load, releasing the overwrapped leading end of packaging material, and securing the released leading end of packaging material between two layers of packaging material.

According to a further aspect of the present invention, a method of securing a final tail of film to a load while wrapping the load with a film web is provided. The method comprises positioning a load on a load support surface adjacent to a fixed wrapping structure, dispensing a film web from a dispenser, providing relative rotation between the load and the dispenser to wrap the film web around the load and the fixed wrapping structure, distending a film path extending between a corner of the load and the dispenser with a portion of the fixed wrapping structure, severing the film between the portion of the fixed wrapping structure and the dispenser, and securing a severed end of film to the load.

According to yet another aspect of the present invention, an apparatus for securing an initial tail of film to a load while wrapping the load with packaging material is provided. The apparatus includes means for holding a leading end of packaging material, means for providing relative rotation between the load and a dispenser to dispense packaging material, means for securing a held leading end of packaging material, and means for securing a released leading end of packaging material between two layers of packaging material.

According to another aspect of the present invention, an apparatus for securing an initial tail of film comprises a film dispenser, a load support surface, a film clamp, means for providing relative rotation between the load and the dispenser to wrap film around the sides of the load, a fixed wrapping structure positioned between the film clamp and the load support surface, the fixed wrapping structure having a proximal end portion, a distal end portion, and a top surface extending between the proximal and distal end portions, the proximal end of the wrapping structure being positioned such that a leading end of film held by the film clamp passes over the top of the fixed wrapping structure while film dispensed during relative rotation between the dispenser and the load engages the proximal end portion of the fixed wrapping structure.

According to a further aspect of the present invention, an apparatus for securing a final tail of film to a load while wrapping the load with a film web is provided. The apparatus comprises a load support surface, a film dispenser, means for providing relative rotation between the load and the dispenser to wrap the film web around the load and the fixed wrapping structure, means for distending a film path extending between a corner of the load and the dispenser, means for severing the film along the film path, and means for securing a severed end of film to the load.

According to yet another aspect of the present invention, an apparatus for securing an initial tail of film and a final tail of film to a load while wrapping the load with a film web is provided. The apparatus includes means for holding a leading end of a film web, means for providing relative rotation between the load and a dispenser to dispense the film web, means for securing a held leading end of the film web, means for securing a released leading end of the film web between two layers of film, means for distending a film path extending between a corner of the load and the dispenser, means for severing the film web along the film path, and means for securing a severed end of film to the load.

According to another aspect of the present invention, a method of securing an initial tail of film and a final tail of film to a load while wrapping the load with a film web is provided. The method includes positioning a load on a load support surface adjacent to a fixed wrapping structure, holding a leading end of a film web extending from a dispenser, providing relative rotation between the load and the dispenser to wrap the film web around the load and the fixed wrapping structure, securing a portion of the leading end of the film web to the fixed wrapping structure prior to releasing the leading end of the film, releasing the leading end of the film web, securing the released leading end of the film web to the load, distending a film path extending between a corner of the load and the dispenser with a portion of the fixed wrapping structure, severing the film between the corner of the load and the dispenser, and securing a severed end of the film to the load.

Additional objects and advantages of the invention will be set forth in part in the description which follows, and in part will be obvious from the description, or may be learned by practice of the invention. Some of the objects and advantages of the invention may be realized and attained by means of the elements and combinations particularly pointed out in the appended claims.

It is to be understood that both the foregoing general description and the following detailed description are exemplary and explanatory only.

BRIEF DESCRIPTION OF THE DRAWINGS

The accompanying drawings, which are incorporated in and constitute a part of this specification, illustrate an exemplary embodiment of the invention and together with the description, serve to explain the principles of the invention. In the drawings.

DESCRIPTION OF THE EMBODIMENTS

Reference will now be made in detail to the present embodiment of the invention, an example of which is illustrated in the accompanying drawings. Wherever possible, the same reference numbers will be used throughout the drawings to refer to the same or like parts.

As used herein, an initial tail of film results when a leading end of packaging material held during the initial stage of a wrapping cycle is released during the wrapping cycle. This released leading end generally has not been attached to the load and instead extends or trails from the load. As used herein, a final tail of film results when the packaging material extending between a corner of the load and the packaging material dispenser is severed at the end of a wrapping cycle. The portion of the film extending between the load and the severed end of film form the final tail of film and may be referred to as a "severed end of film." This severed end of film generally has not been secured to the load and instead extends or trails from the load.

The present invention provides an apparatus and method for minimizing the initial tail of film which may result from releasing the leading end of film during a wrapping cycle. Accordingly, the present invention provides a means for securing the leading end of film to the load after it is released. The means for securing may include a structure to which the released leading end may be affixed with packaging material during the wrapping cycle. Preferably, the means for securing also includes a substantially horizontal plate for receiving and supporting the leading end after it is released from the packaging material holder or clamp. The structure to which the released leading end may be affixed preferably is a substantially vertical fixed structure, such as a vertical plate. By affixing the leading end during wrap cycle, it is possible to avoid the need for additional steps or additional equipment to perform the securing task, such as for example a heat sealer, which would raise the cost of wrapping the load.

The present invention also provides a method and apparatus for minimizing the final tail of film which may result from severing the film between a corner of the load and the film dispenser. Accordingly, the present invention provides a means for securing a severed end of film after the film is severed between the load and the dispenser. The means for securing preferably includes means for distending the film path between the load and the dispenser. The final tail of film is secured to the load during the wrap cycle, eliminating the need for additional steps or additional equipment (such as use of a heat sealer) which would increase costs.

Figure 1:
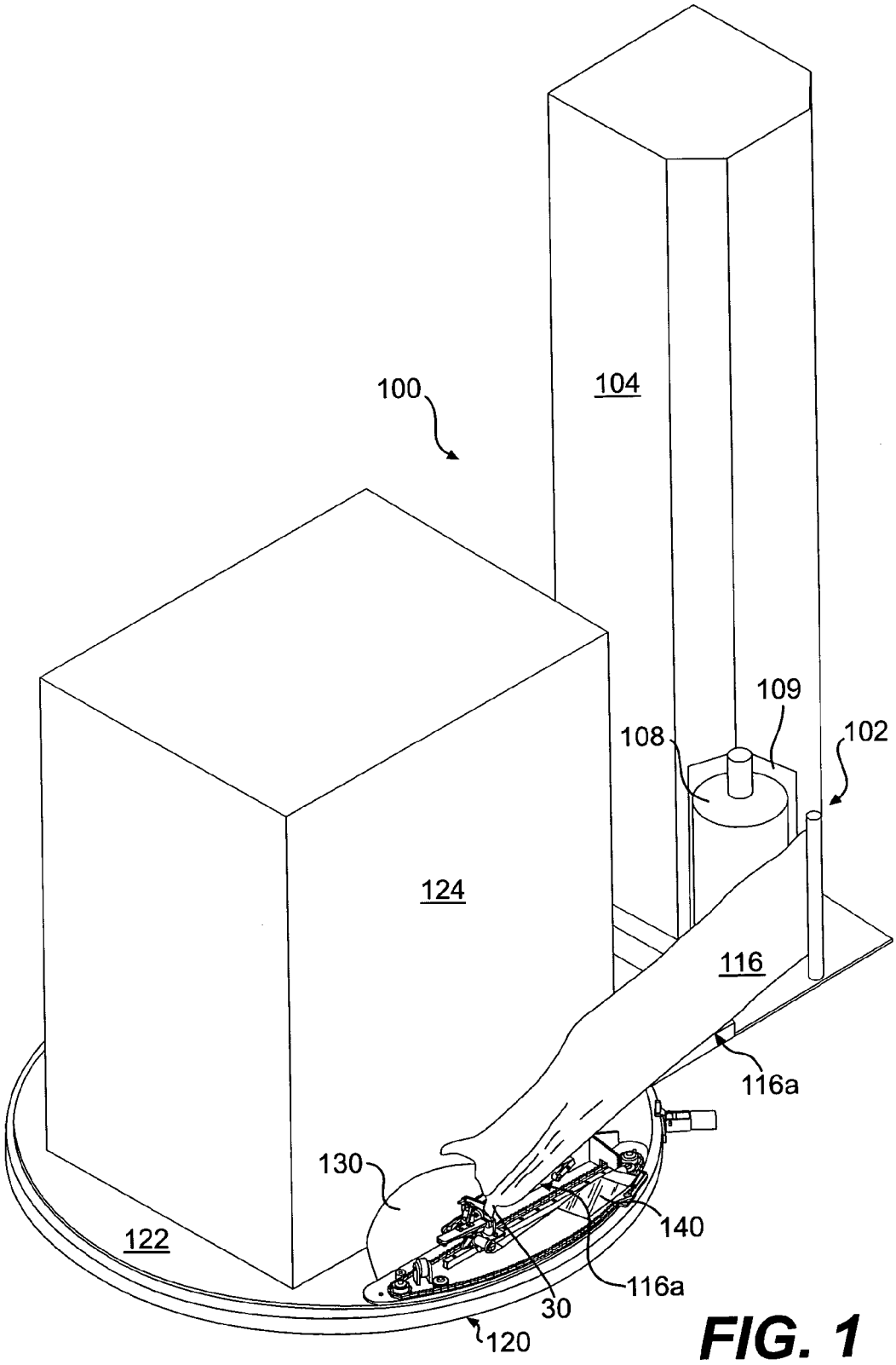
FIG. 1 is an isometric view of a wrapping apparatus, according to an exemplary aspect of the present invention.

As shown in FIG. 1, a dispenser 102 is provided for dispensing packaging material. Packaging material dispenser 102 dispenses a sheet of packaging material 116 in a web form and includes a roll carriage 109 that supports a roll of packaging material 108. Roll carriage 109 of dispenser 102 is mounted on and vertically moveable on a mast 104, shown in FIGS. 1 and 2, to dispense packaging material 116 spirally about load 124 as rotation is provided between load 124 and dispenser 102. Roll carriage 109, as embodied herein and shown in FIG. 1, includes a support for packaging material roll 108 and means for moving on mast 104. Alternatively, roll carriage 109 may include a container for holding packaging material roll 108, and a slit for dispensing packaging material 116 from packaging material roll 108. As used herein, the terms "film," "film web," "stretch wrap," "wrap," and "packaging material" are interchangable.

In an exemplary embodiment, stretch wrap packaging material is used. In the stretch wrapping art, stretch wrap packaging material is known to have a high yield coefficient to allow the material a large amount of stretch during wrapping. Various other packaging materials, generally not considered to be stretch wrap materials, such as netting, strapping, banding, and tape, can be used as well. Dispenser 102 may also include a variety of rollers, optionally including prestretch rollers for stretching the packaging material longitudinally and/or transversely, to position, dispense, and stretch the packaging material as packaging material 116 is being dispensed from the roll of packaging material.

In the present invention, apparatus 100 includes means for providing relative rotation between the dispenser and the load to wrap packaging material around the load. As embodied herein and shown in FIGS. 1 and 2, the means for providing relative rotation include a conventional turntable assembly 120 having a rotatable turntable 122. Load 124 is rotated by rotatable turntable 122 to provide relative motion between dispenser 102 and load 124 to wrap packaging material around the sides of the load.

Figure 2:
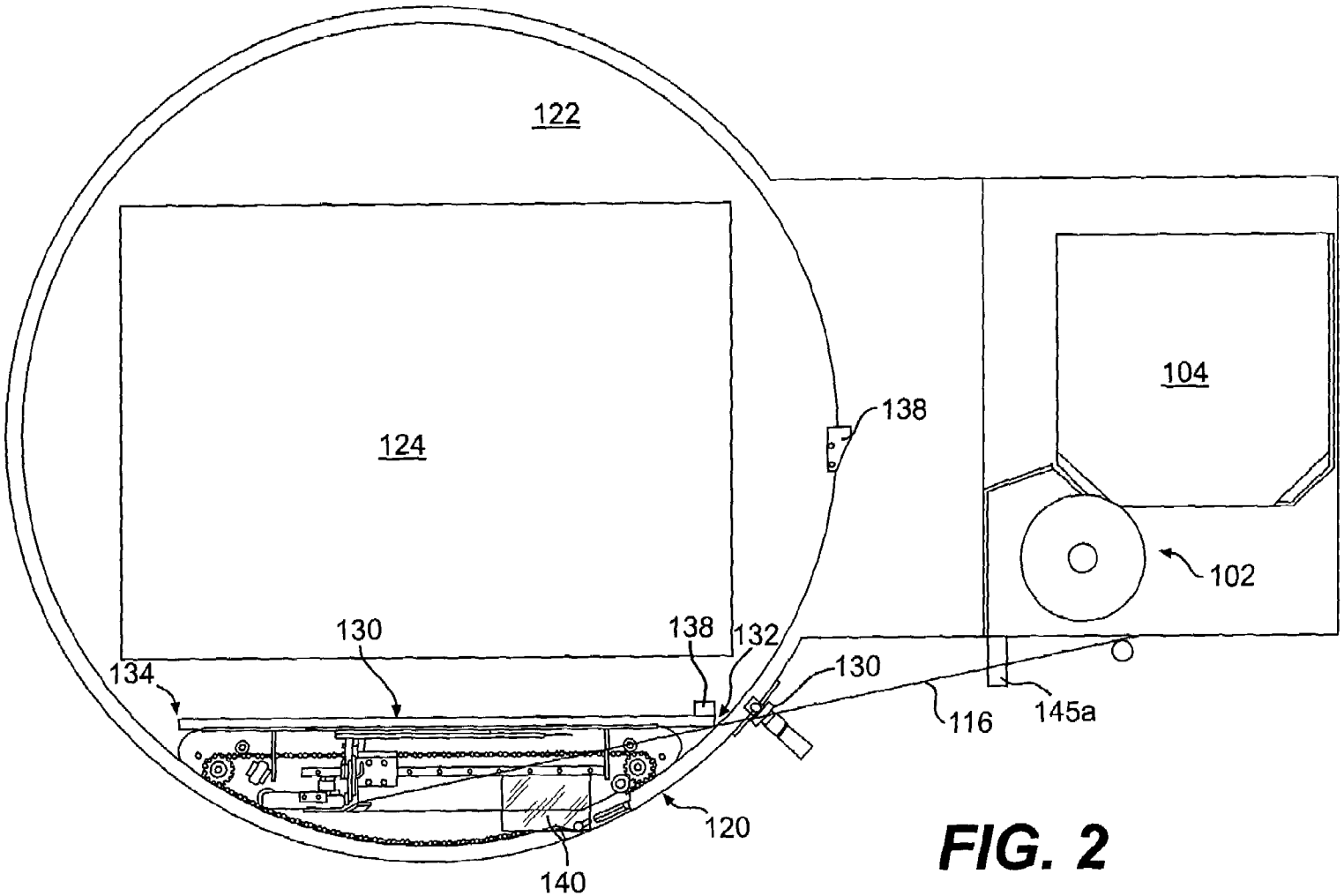
FIG. 2 is a top view of the apparatus of FIG. 1.

As shown in FIGS. 1 and 2, turntable assembly 120 may include a rotatable turntable 122. Additionally, as shown in FIGS. 6–20, rotatable turntable 122 may include non-powered upper conveyor surface with a plurality of non-powered rollers for supporting the load during wrapping. Alternatively, instead of non-powered rollers the conveyor surface may be powered.

Rotatable turntable 122 may further include a packaging material holder assembly 110 for holding a leading end of the packaging material during wrapping of the load. As embodied herein and shown in FIGS. 1–5, a packaging material holder 110 may be mounted on rotatable turntable 122 of turntable assembly 120. Packaging material holder 110 may include a clamp 111 for grasping, holding, and releasing packaging material 116, and a mechanical movement for actuating the clamp. A roper for forming a rope of the packaging material 116, and a packaging material weakener for weakening the packaging material prior to severing may be provided as well.

The clamp 111 for holding and releasing packaging material 116, as shown in FIGS. 1–4, preferably includes opposed surfaces for grasping the packaging material 116, such as jaws 112, 114. Jaws 112, 114 may be made of any suitable material, such as metal or plastic, and in any suitable shape which will allow the jaws to grasp and hold the packaging material without severing it. Jaws 112, 114 are preferably mounted on a rail mounted on the turntable to allow jaws 112, 114 to translate relative to the turntable.

Figure 3:
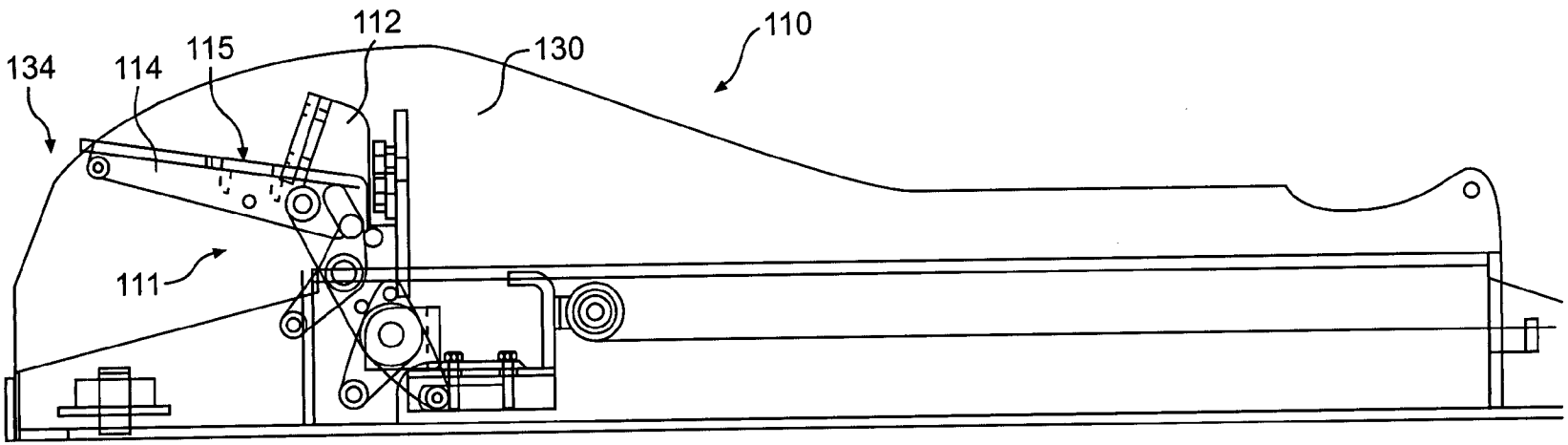
FIG. 3 is a side view of a film clamp and fixed wrapping structure, according to an exemplary aspect of the invention.

Other alternative embodiments of the packaging material holder may include other arrangements such as a single unopposed packaging material engaging surface, or a sticky or tacky surface for holding the packaging material, or in some instances, a vacuum surface. Preferably, clamp 111 includes means for weakening the packaging material 115, as shown in FIG. 3. Suitable means for weakening the packaging material are disclosed in U.S. Pat. No. 6,269,610 and U.S. Pat. No. 6,185,900, both of which are incorporated herein by reference in their entirety. Clamp 111 may be electrically powered or mechanically actuated. Examples of suitable packaging material holders also are disclosed in U.S. Pat. No. 6,269,610 and U.S. Pat. No. 6,185,900, both of which are incorporated herein by reference in their entirety. Alternatively, instead of a packaging material assembly 110, a clamp or other means may be used to restrain the leading end of the packaging material during wrapping.

Figure 5:
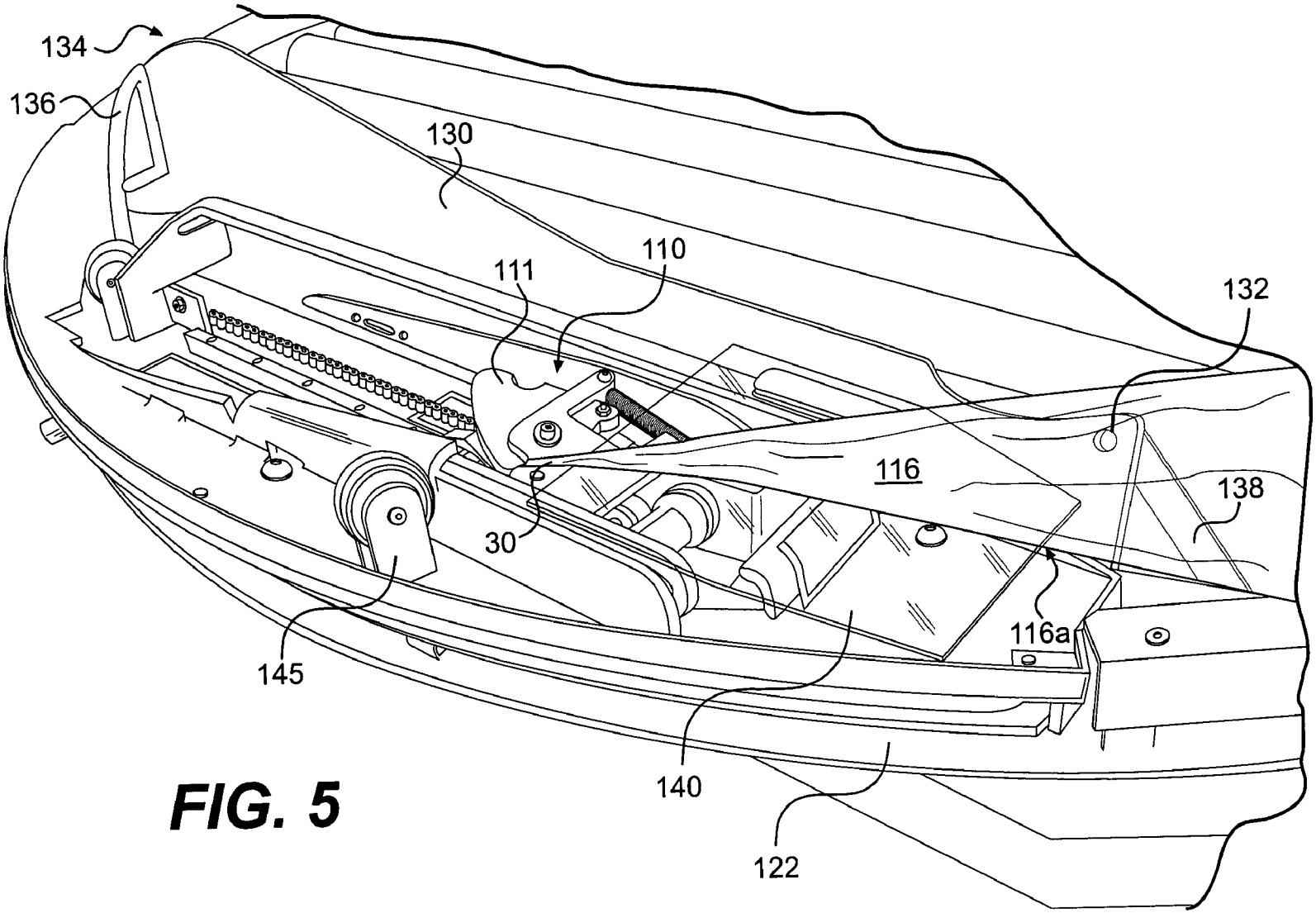
FIG. 5 is a partial isometric view of a film clamp, tail sweep plate, and fixed wrapping structure, according to an exemplary aspect of the invention.
Figure 6:
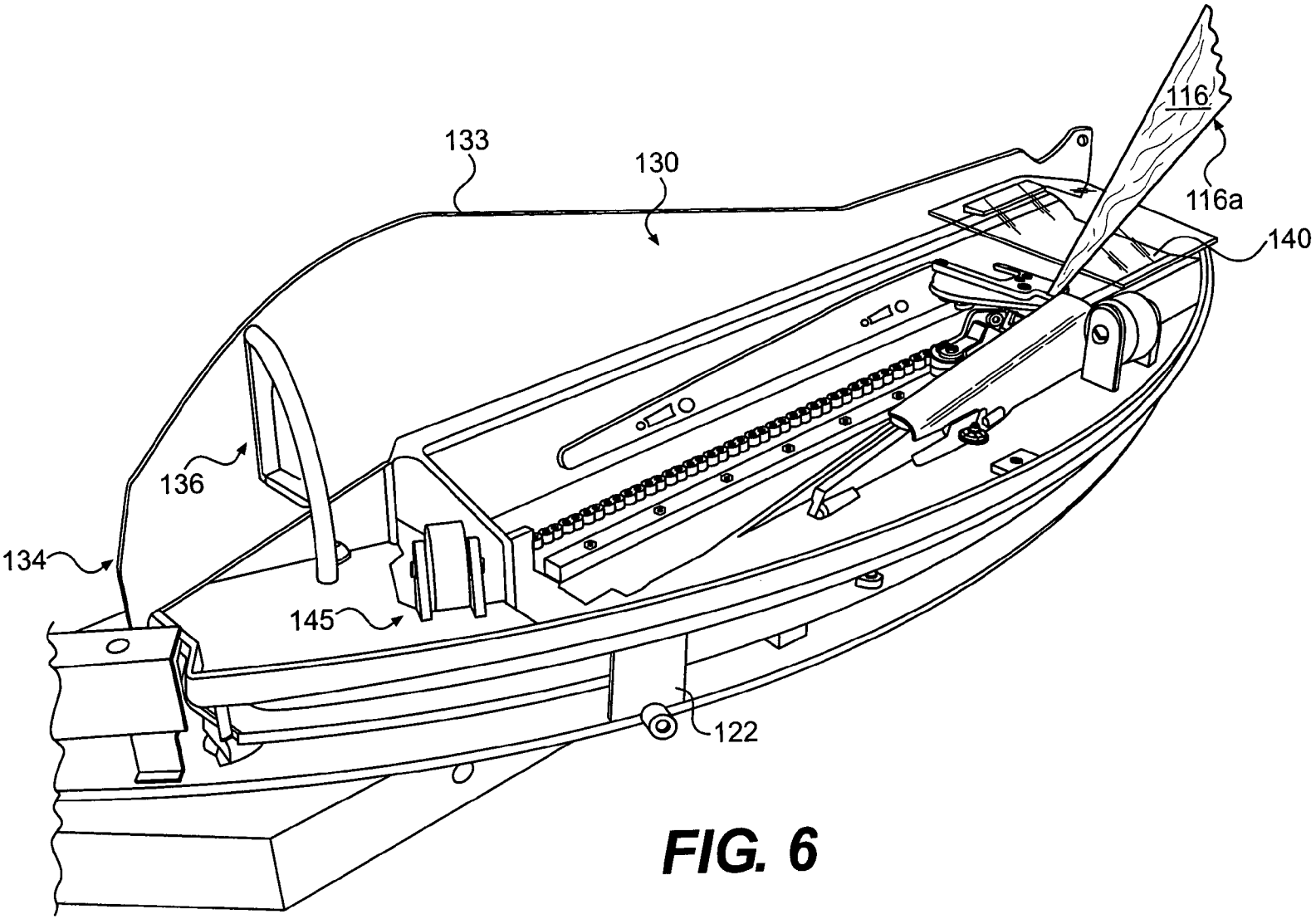
FIG. 6 is a partial isometric view of a film clamp, tail sweep plate, and fixed wrapping structure mounted on a turntable, according to an exemplary aspect of the invention.

According to one aspect of the invention, a means for securing an initial tail of film to a load during wrapping is provided. Preferably, the means for securing includes a fixed wrapping structure to which a portion of the initial tail of film may be fixed. As shown in FIGS. 5 and 6 and embodied herein, a fixed wrapping structure 130 is positioned on the turntable 120. Fixed wrapping structure 130 may be a fixed solid plate that separates the portion of the rotatable turntable 122 supporting packaging material holder 110 from the remainder of the turntable surface 122 which forms a load support surface for supporting the load 124 during wrapping. Alternatively, fixed wrapping structure 130 may be a rail or other structure.

In an exemplary embodiment, fixed wrapping structure 130 extends along substantially the entire length of packaging material holder 110. Fixed wrapping structure 130 may have any shape that permits overwrapping of the structure 130 with packaging material without interference from the packaging material holder 110 or clamp 111 when the clamp is in its wrapping position (i.e., holding a portion of packaging material). It should be understood that different types of clamps/packaging material holders may be used with the fixed wrapping structure of the present invention and therefore the shape of the structure 130 may vary according to the type of clamp used.

The fixed wrapping structure 130 permits the leading end 30 of the packaging material 116, when held by clamp 111, to pass over a top surface of the fixed wrapping structure to engage a corner of the load 124. For example, if one were to picture the corner of the load as a point on a clock, the clamp 111 holding the leading end 30 would form the center of the clock, and the packaging material 116 extending between the two would form the hand of the clock. In such an example, it is preferable that the corner of the load 124 be positioned between twelve o'clock and two o'clock. Therefore, the fixed wrapping structure 130 must extend sufficiently proximally (i.e., toward the dispenser 102) to allow the film 116 to pass over the structure 130 to a corner of the load in this position. However, the fixed wrapping structure 130 cannot extend so far proximally that it interferes with the web of film 116, resulting in a load that is not wrapped tightly.

Preferably, fixed wrapping structure 130 extends about two inches above a bottom surface 116*a* of the web of packaging material 116 extending between the load 124 and the dispenser 102. The bottom surface 116*a* of the web of packaging material 116 may be a lower edge of the web of packaging material 116, or it may be a roped portion 118 (not shown) of the packaging material 116. Specifically, fixed wrapping structure 130 must be elevated sufficiently to allow the packaging material 116 to overwrap it during the wrapping cycle, thereby securing the initial tail of film to the load.

Figure 7:
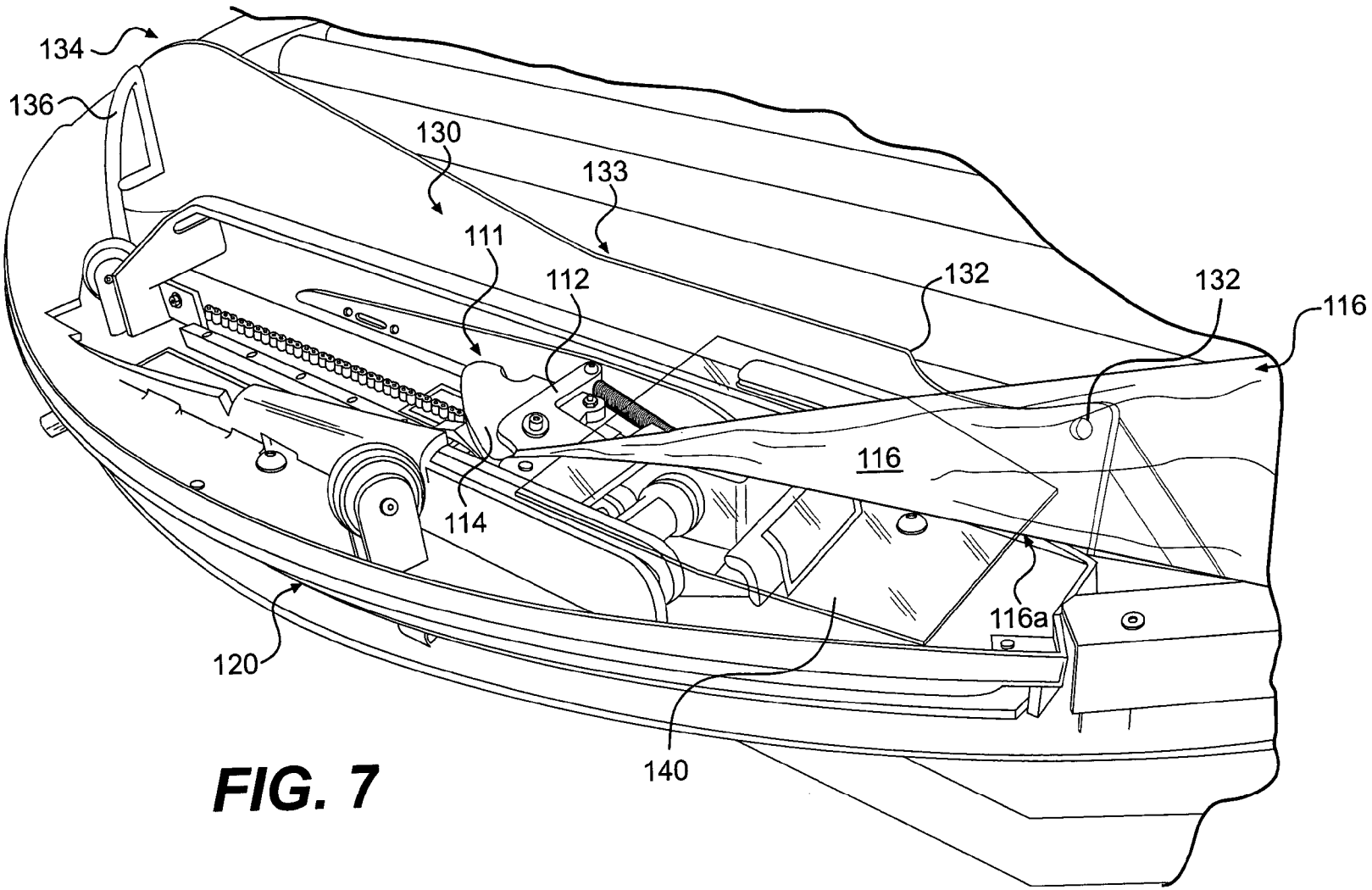
FIG. 7 is a partial isometric view of a film clamp, tail sweep plate, and fixed wrapping structure mounted on a turntable having a load support surface with rollers, according to an exemplary aspect of the invention.
Figure 8:
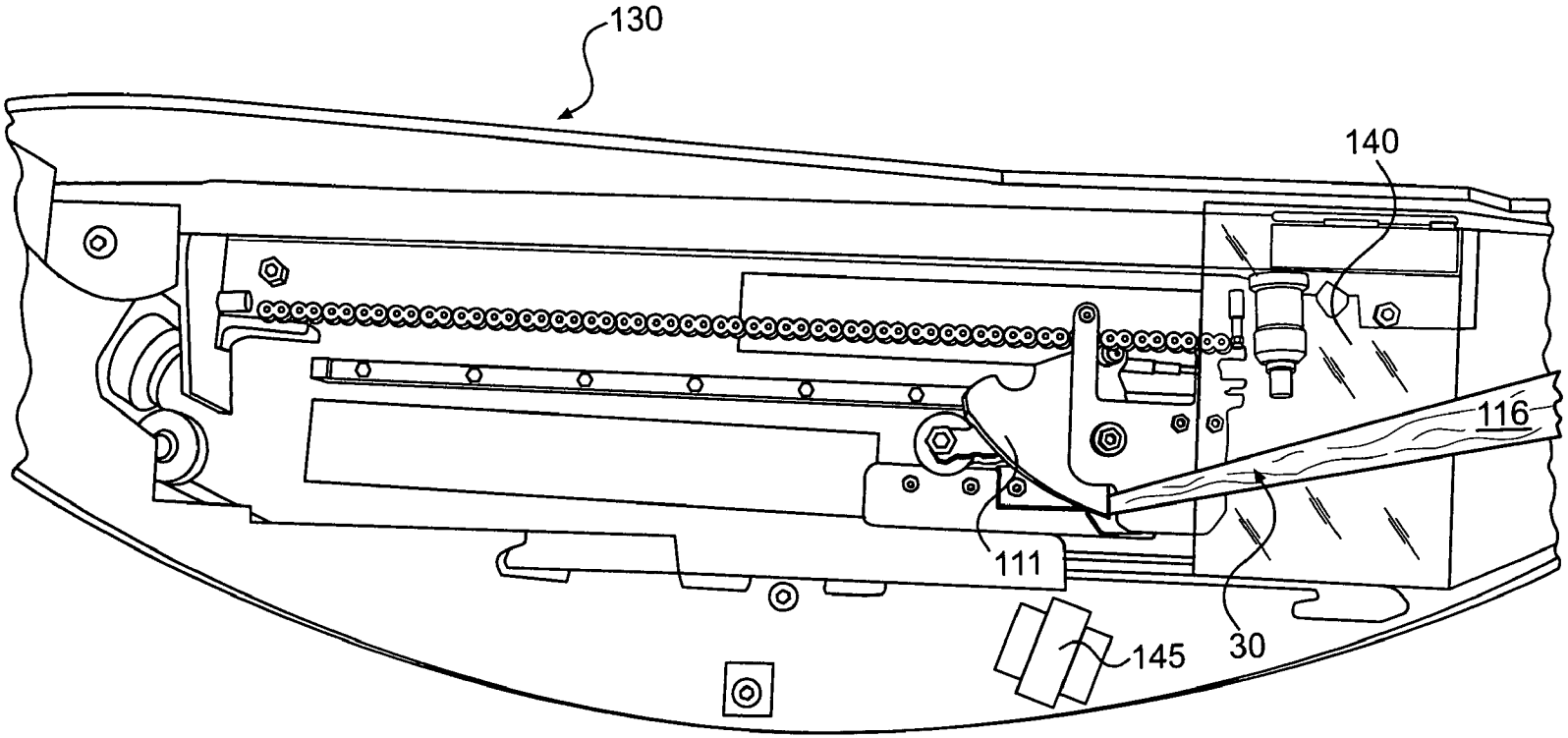
FIG. 8 is a top view of a film clamp, tail sweep plate, and fixed wrapping structure, according to an exemplary aspect of the present invention.

As shown in FIGS. 6 and 7, fixed wrapping structure 130 may be a metal plate. The metal plate may be attached to the turntable 122 and may extend vertically upward from the turntable 122. The metal plate of fixed wrapping structure 130 may be fixedly connected to the turntable 122 or hingedly connected to facilitate easier removal of the overwrapped packaging material 116 from fixed wrapping structure 130 after wrapping. In an apparatus in which a fork truck or other means is used to lift the load 124 off of a wrapping surface, the fixed wrapping structure 130 need not be movable with respect to the turntable 122.

However, in a conveyor situation, for example, where the load 124 will be pushed off the wrapping surface, the fixed wrapping structure 130 may be movable with respect to the wrapping surface to allow the fixed wrapping structure 130 to be moved from between the packaging material 116 and the load 124. This may be accomplished by, for example, the use of hinges. If hinges are used, the hinges may require a certain amount of force, such as the fixed wrapping structure 130 being pushed, to cause the fixed wrapping structure 130 to move with respect to the wrapping surface. This may prevent premature release of the packaging material 116. This embodiment may be particularly suitable for use with the non-powered conveyor and pusher system disclosed in U.S. patent application Ser. No. 09/985,156, filed on Nov. 1, 2001, and entitled "Method and Apparatus for Wrapping a Load," the entire contents of which is incorporated herein by reference.

Fixed wrapping structure 130 has the added benefit of protecting the packaging material holder 110 from loading equipment when a load is being placed on or removed from the load support surface of the turntable 122. For example, it is common to use forklift trucks to place loads onto the turntable prior to wrapping. The fixed wrapping structure 130 prevents the forks of the forklift truck from inadvertently coming into contact with and damaging the packaging material holder 110. The fixed wrapping structure 130 also protects the packaging material holder 110 from the load 124.

As shown in FIGS. 6 and 7, fixed wrapping structure 130 includes a top surface 133 extending between two end portions 132, 134. The two end portions of the fixed wrapping structure 130 are referred to as the proximal and distal end portions 132, 134 of the fixed wrapping structure 130, with respect to their positions relative to the packaging material dispenser 102.

The proximal corner 132 of the fixed wrapping structure 130 may include a film release bar 138. As embodied herein and shown in FIG. 15, film release bar 138 may be a simple steel or aluminum bar. A first end of film release bar 138 is connected to the proximal corner 132 of fixed wrapping structure 130. A second end of the film release bar 138 is connected to the rotatable turntable surface 122. Preferably, film release bar 138 is slightly angled between the fixed wrapping structure 130 and the turntable surface 122. This incline permits the film 116 to slide off of proximal corner 132 of the fixed wrapping structure 130 when the load 124 is being removed from the turntable 122 after wrapping. If the fixed wrapping structure 130 is hingedly connected to the turntable 122, it is not necessary to provide film release bar 138.

Figure 10:
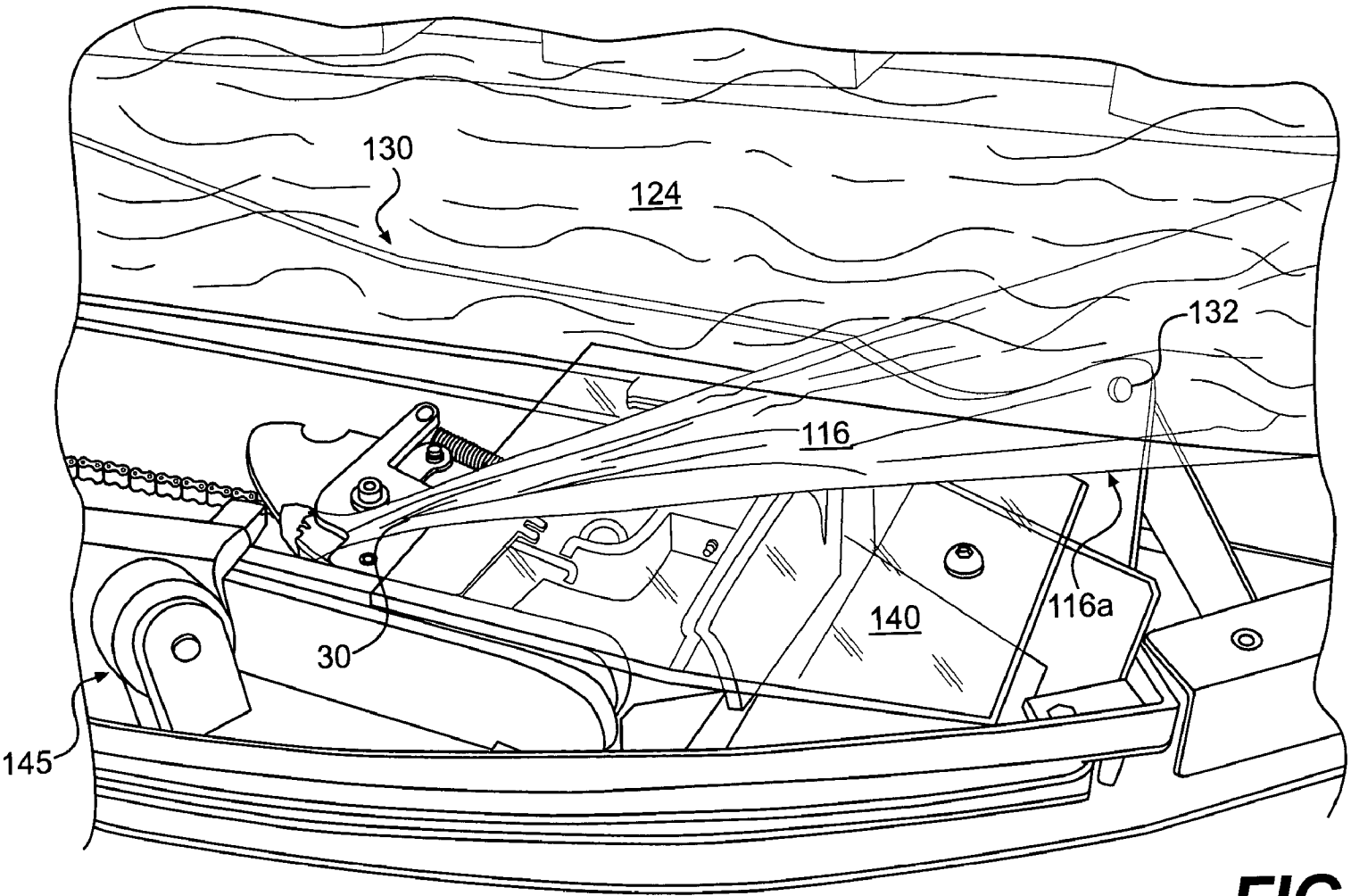
Figure 11:
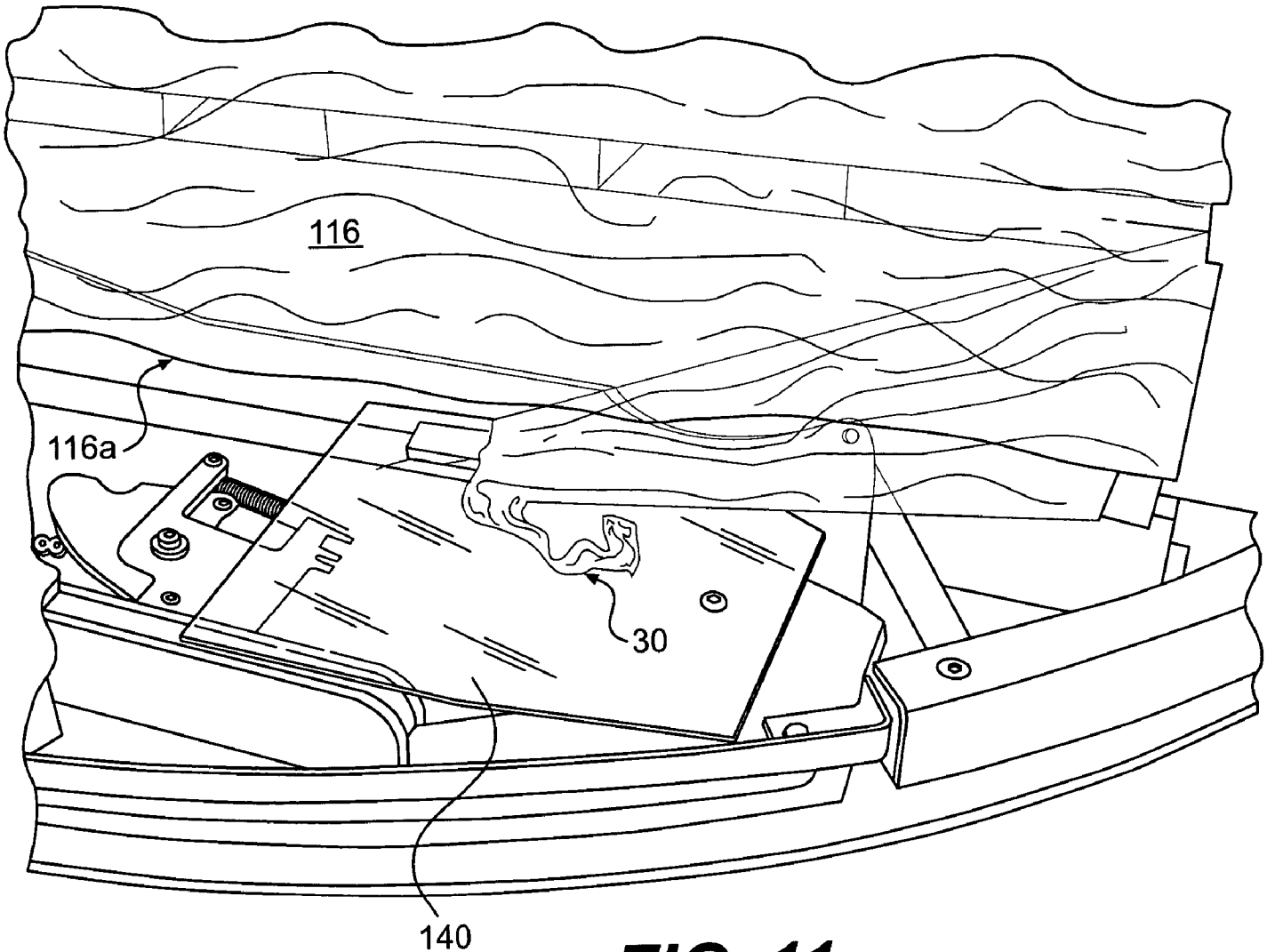

The means for securing an initial tail of film to the load 124 during wrapping also may include a tail sweep plate. As embodied herein and shown in FIGS. 4, 5, 8, and 9, tail sweep plate 140 may be a substantially flat plate positioned near the proximal corner 132 of fixed wrapping structure 130. Tail sweep plate 140 is also positioned near film clamp 111. This positioning of tail sweep plate 140 allows the plate to support an initial tail of film 150 after it is released from the film clamp 111, as shown in FIG. 11. The positioning of tail sweep plate 140 also places the released initial tail of film 150 in the path of the web of film 116 during the wrapping process. As embodied herein and shown in FIGS. 6–19, tail sweep plate 140 may be a piece of Plexiglas. Alternatively, tail sweep plate 140 may include rollers, a metal plate, or a piece of nylon mesh. Any material suitable to support the initial tail of film 150 and place it in the path of the web of film 116 during wrapping may be used.

Tail sweep plate 140 may be positioned such that it slopes slightly downward, away from fixed wrapping structure 130. This slight downward slope enhances the "sweeping" of the initial tail 150 by the web of packaging material 116 as it passes over plate 140. Alternatively, the plate 140 may be positioned substantially flat and an outer edge of the plate may be beveled to provide the desired enhanced sweeping affect by "ramping up" the packaging material 116 to the top of the plate 140. The plate 140 preferably is positioned immediately above the bottom surface **116*a* of the web of film 116 extending between the dispenser 102 and the load 124. An example of a preferred distance that the plate 140 is positioned above the bottom surface 116*a* of the web of film 116 is about one quarter (¼) inch. Other distances may be used so long as the plate is elevated sufficiently to allow the bottom surface 116*a* of the web of packaging material 116 to move over plate 140 and sweep up the initial tail 150 as the web 116 moves over the plate 140. As the web 116 "sweeps up" the initial tail 150, it moves into contact with the fixed wrapping structure 130, and thereby secures the initial tail of film 150 to the packaging material 116 wrapped around the load 124**.

Figure 4:
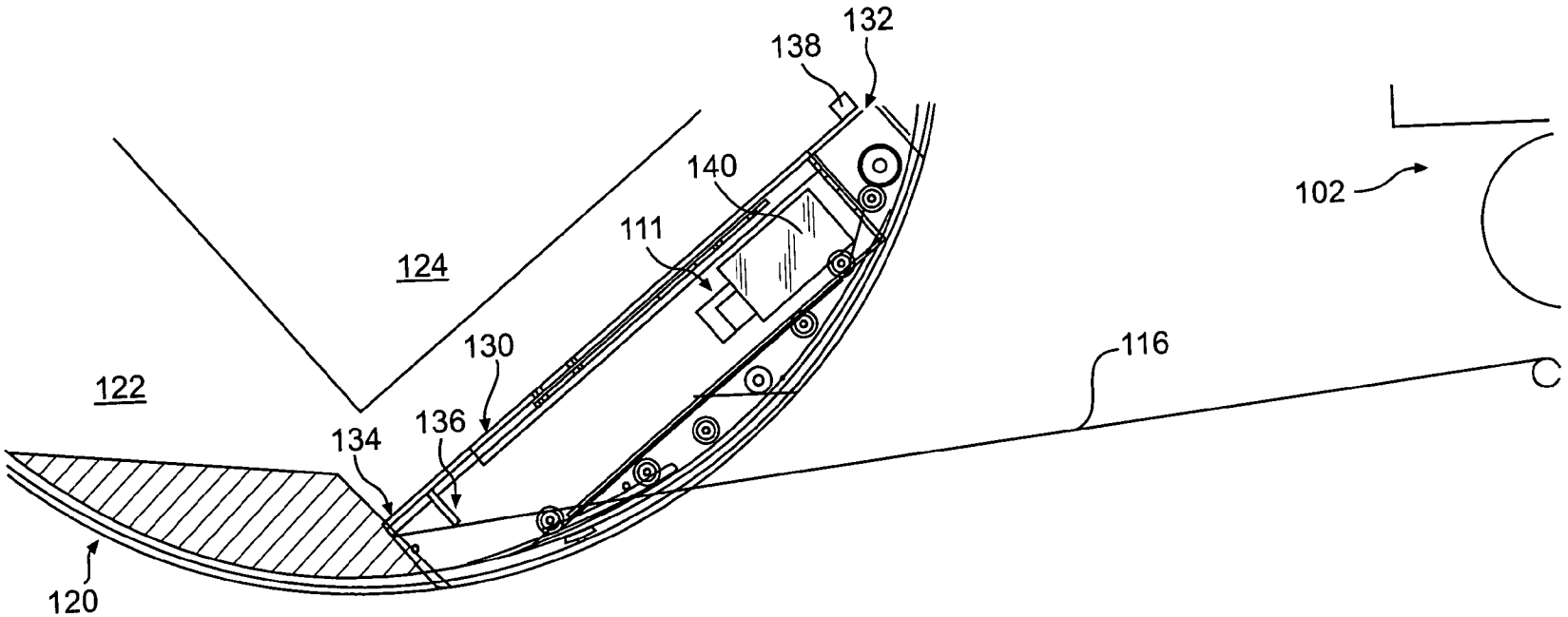
FIG. 4 is a partial top view of a wrapping apparatus including the film clamp and fixed structure of FIG. 3, according to an exemplary aspect of the present invention.

The distal corner portion 134 of the fixed wrapping structure 130 provides a consistent framework for assisting in breaking the packaging material after the load 124 has been wrapped. In prior art devices, it is necessary to position the load to be wrapped within a certain zone on the turntable in order to ensure that the packaging material 116 will properly contact the corners of the load 124 to form a workable film path between the dispenser 102 and the load 124, at an angle that will allow a clamp 111 or a packaging material holder 110 to intercept the packaging material 116. For example, prior to the present invention, it was necessary that a corner of a load to be wrapped be placed in the shaded area of the turntable as shown in FIG. 4. With the corner of the load placed in the shaded area, it could be assured that as the turntable rotated, the angle of the film path of the packaging material will intercept the clamp or the packaging material holder.

With the present invention, the packaging material 116 intercepting the distal end portion 134 of the fixed wrapping structure 130, and not the corner of the load 124, determines the angle of the film path to the dispenser 102. This may eliminate worries about positioning the corner of the load 124, and also provide a consistent angle of the film 116 from the distal corner 134 of the fixed wrapping structure 130 to where the film 116 is eventually cut between the load 124 and the dispenser 102. This consistent angle results in a uniformly sized graspable tail of packaging material extending from the dispenser after each wrapping cycle.

According to another aspect of the present invention, a means for securing a trailing end of film is provided. As embodied herein and shown in FIG. 6, the distal end portion 134 of the fixed wrapping structure 130 may include a film engaging protrusion such as a knuckle 136. Knuckle 136 may be a curved protuberance, such as a curved bar, for example, that extends between the packaging material holder 110 and the fixed wrapping structure 130, as shown in FIG. 6. Knuckle 136 protrudes outwardly from fixed wrapping structure 130, thereby engaging the film 116 as the film 116 moves from the distal end portion 134 toward proximal end portion 132 of fixed wrapping structure 130. As the film 116 engages knuckle 136, it "bonds" or sticks to knuckle 136, and each successive wrap of film 116 bonds to the previous layer of film wrapped over knuckle 136. This includes the last wrap of film 116 before the film 116 is severed and clamped between the distal corner 134 and the dispenser 102. The knuckle 136 distends the film as it follows a film path between a corner of the load 124 near distal end 134 of fixed wrapping structure 130 and the dispenser 102.

Figure 17:
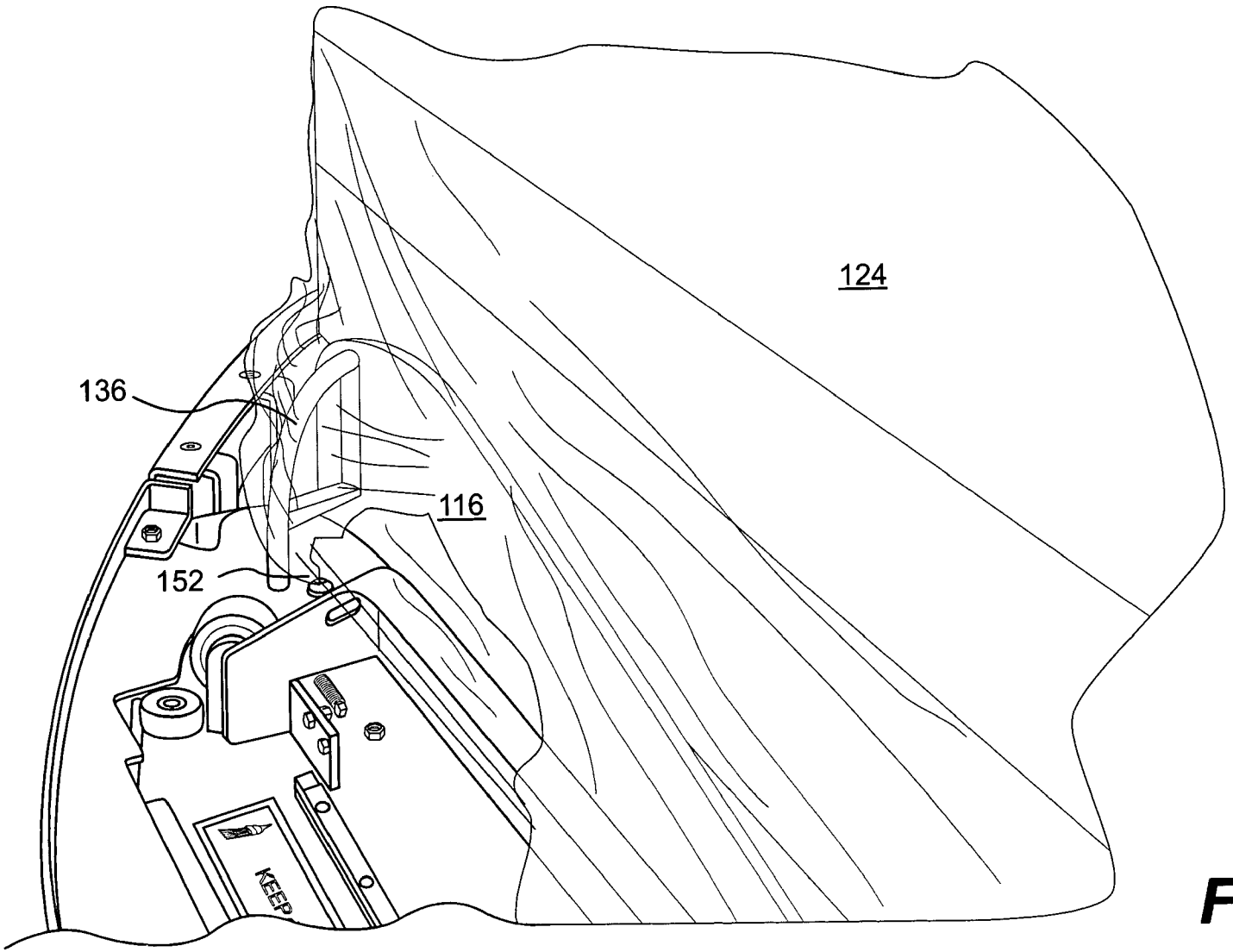
Figure 18:
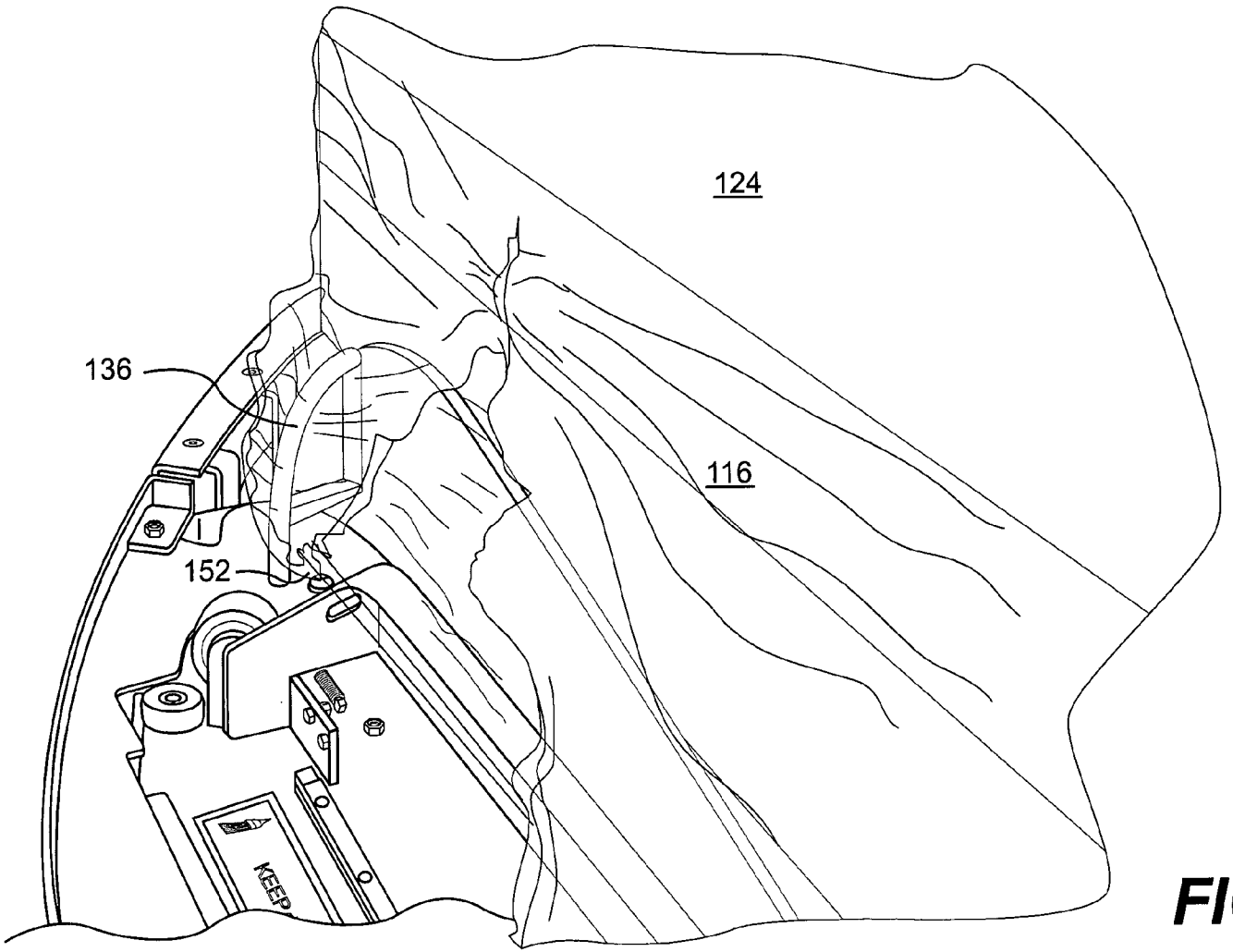
Figure 19:
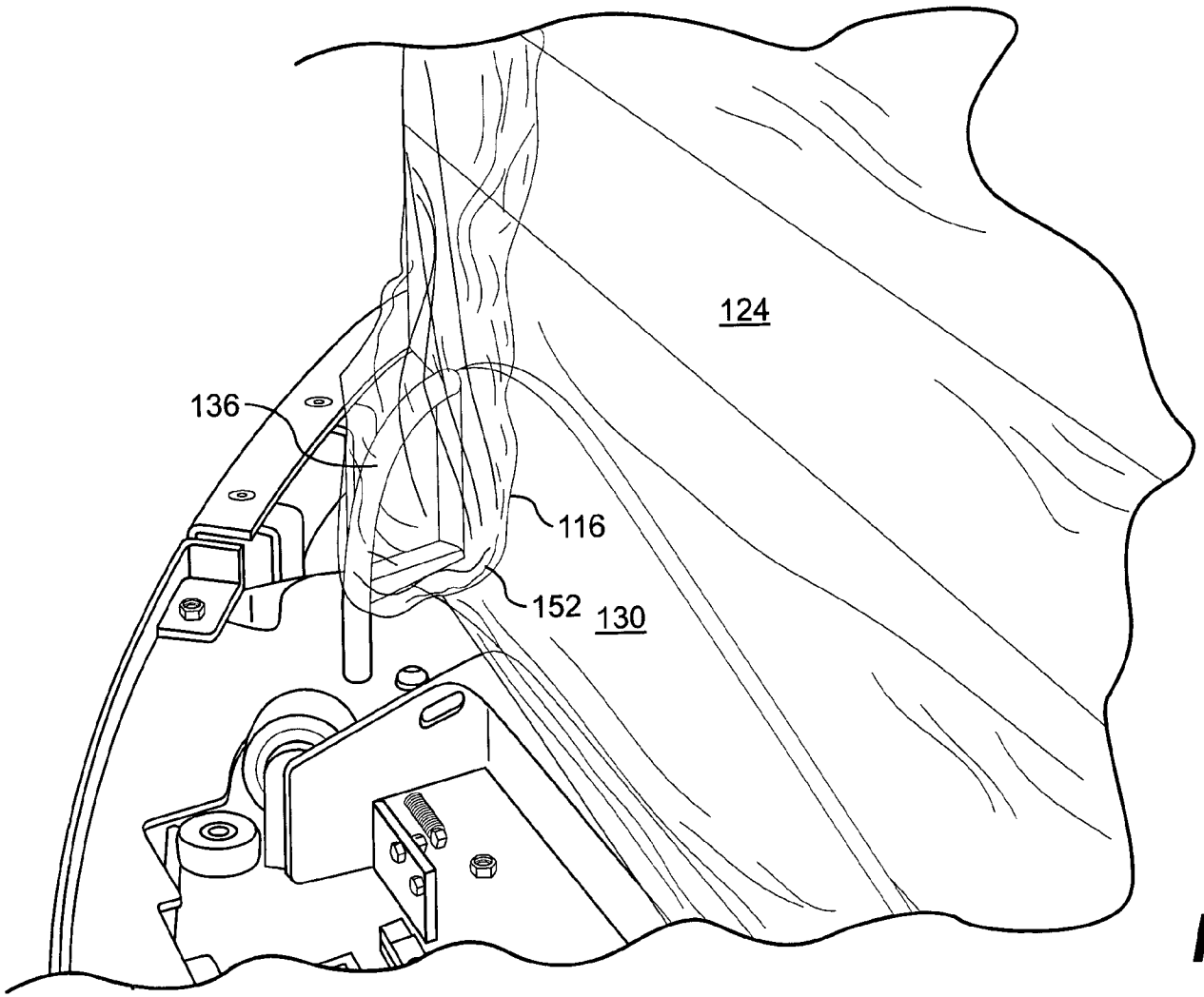
Figure 20:
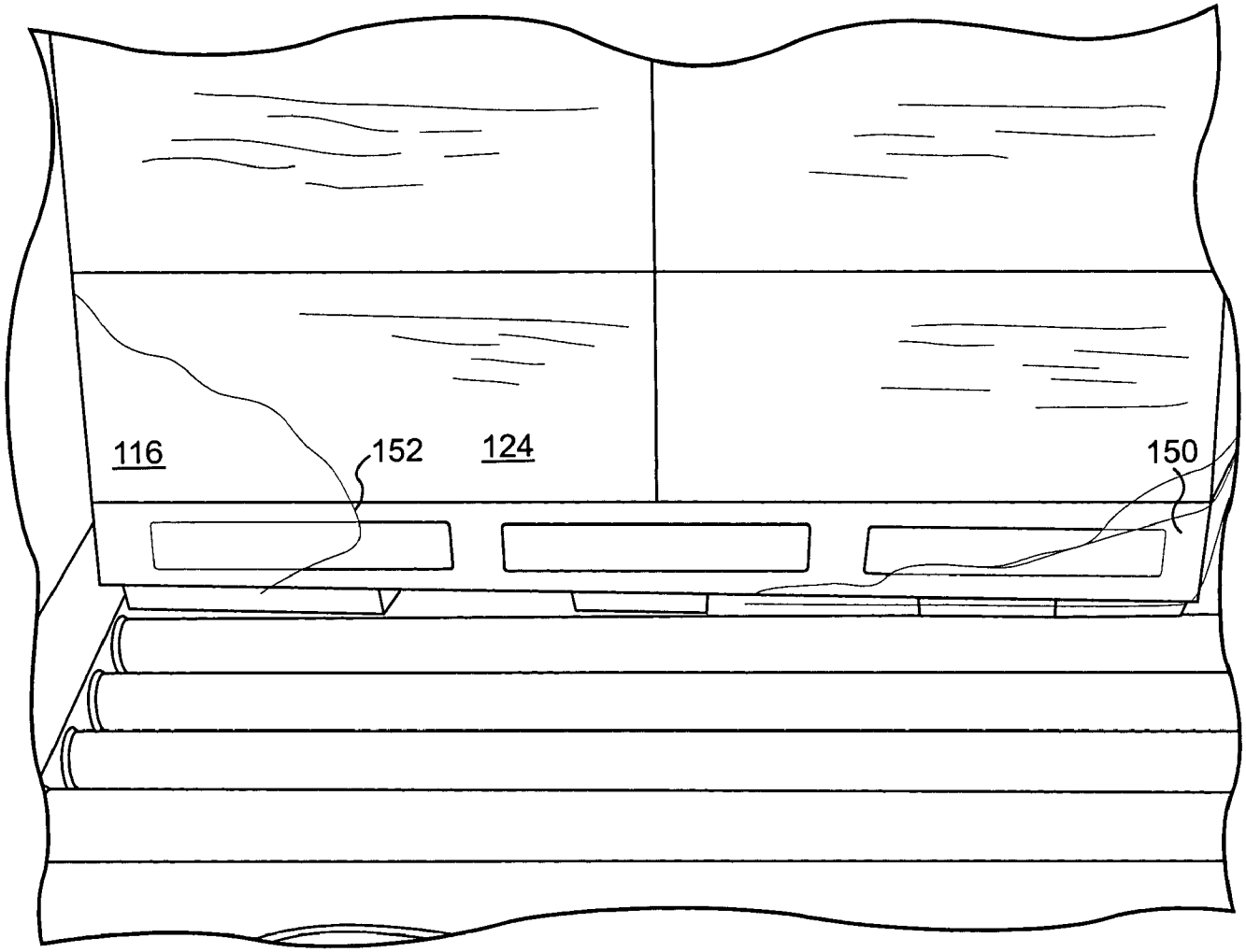

As shown in FIGS. 17–19, the last layer of wrap adheres to knuckle 136 distal of weakened area of the film between the load 124 and the dispenser 102. As the load 124 rotates to tear the weakened film, the final tail of film 152 is created and the final tail 152 adheres to the previous layer of film on knuckle 136, as shown in FIG. 19. This serves to secure the final tail of film 152 to the layers of film 116 on the load 124, as shown in FIG. 20.

According to another aspect of the invention, a roper may be provided for forming a rope of packaging material. As discussed herein, "roping" packaging material means rolling or twisting or collapsing a portion of the web of packaging material 116 to shape it into a rope-like form. In order to withstand a starting force during wrapping, at least 20% of the web of packaging material 116 should be held by the packaging material holder 110. For example, a web 116 of packaging material twenty (20) inches high may have a five (5) or six (6) inch portion formed into a rope. This allows the jaws 112, 114 to engage a rope 118 (not shown) and a portion of the web of packaging material 116, rather than holding only a small portion of the packaging material 116 between the opposing surfaces. As seen in FIGS. 1 and 2, jaws 112, 114 can grasp a substantial cross section of the web of packaging material 116 when it has been roped. This gives the lower portion of the web of packaging material 116 between jaws 112, 114 and dispenser 102 the triangular shape seen in FIGS. 1 and 2. As embodied herein and shown in FIGS. 5 and 6, the roper includes a roller or wheel 145. Alternatively, as shown in FIG. 2, the roper may include a bar 145*a* extending from a base portion of dispenser 102. As packaging material 116 moves between the dispenser and the load, it passes over bar 145*a* and bar 145*a* ropes the bottom of the web of film.

The leading end 30 of the packaging material 116 held by the clamp 111 forms an initial tail of film 150 when it is released. When the packaging material is severed or torn between the load 124 and the dispenser 102 at the end of the wrap cycle, the trailing end of the film forms a final tail of film 152. Although the packaging material 116 is severed between the load 124 and the dispenser 102, the knuckle 136 extends into the film path between the corner of the load 124 and the dispenser 102, as shown in FIG. 17. As the packaging material is severed, the final tail of film 152 snaps back toward the corner of the load 124 and engages knuckle 136, and the final tail 152 adheres to the previous layers of packaging material 116 overwrapping knuckle 136, thus securing the final tail 152 to the packaging material 116 around the load 124.

Figure 9:
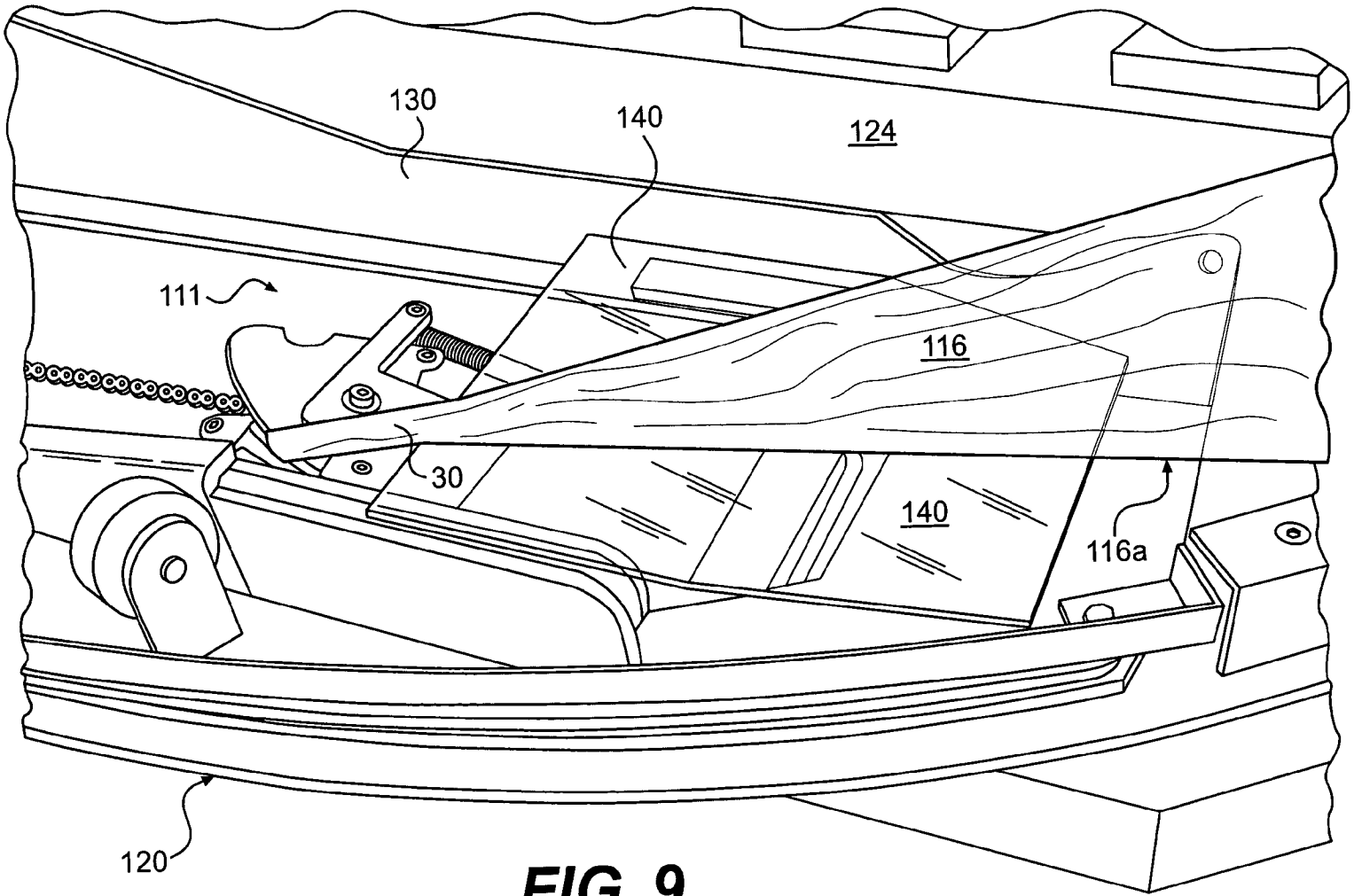
FIGS. 9–20 are partial isometric views of the film clamp, tail sweep plate, and fixed wrapping structure of FIG. 7 during various stages of a wrapping cycle, according to an exemplary aspect of the present invention.

A method of use of the present invention will now be described with respect to FIGS. 9–20. As shown in FIG. 9, a load 124 to be wrapped is placed on a load support surface of the rotatable turntable 122. The load 124 is placed near the fixed wrapping structure 130. Best containment of the load 124 is achieved when the load is placed in a range of positions varying from directly adjacent the fixed wrapping structure 130 to approximately four (4) inches away from fixed wrapping structure 130. The load 124 may be placed more than four inches away from the fixed wrapping structure 130, however, it should be noted that the larger the distance between the load 124 and the fixed wrapping structure 130, the greater the likelihood that the film 116 will be distended, resulting in a loosely wrapped load 124.

Initially, a film clamp 111 holds a leading end 30 of the web of packaging material 116, which extends between clamp 111 and dispenser 102, over tail sweeping plate 140. Relative rotation is provided between the load 124 and the dispenser 102 by rotating turntable 122. As the load 124 and turntable 122 rotate, the packaging material 116 is dispensed from the dispenser 102 and wrapped around the load 124. As shown in FIG. 10, during the first rotation of the turntable 122 the packaging material 116 overwraps fixed wrapping structure 130, such that fixed wrapping structure 130, including knuckle 136, is between the load 124 and a first layer of packaging material 116. If the bottom surface 116*a* of the film web 116 moves over a roper, such as wheel 145, the bottom portion 116*a* of the web 116 may be formed into a rope portion 118 (not shown). As the bottom surface 116*a* of the web of film 116 (or rope portion 118) moves over tail sweeping plate 140, it overwraps the portion of the packaging material 116 extending from the clamp 111 and secures it to the fixed wrapping structure 130.

As the rotation of the turntable 122 continues, dispenser 102 travels vertically upward on mast 104 to wrap packaging material 116 around the load 124. While the dispenser 102 is at the top of the mast 104, the turntable 122 slows and the packaging material clamp 111 may be actuated or opened to release the leading end 30 of packaging material 116. When clamp 111 releases the leading end 30, the initial tail 150 is formed and will lay on tail sweeping plate 140, as shown in FIG. 11. In this embodiment, the leading end 30 is released while the dispenser 102 is at the top of the mast 104 in order to prevent interference between the clamp 111 and the web of film 116. It should be understood that the releasing step may occur at any point in the wrap cycle after a portion of the initial tail has been secured to the fixed wrapping structure 130 while the clamp holds the leading end 30 of the packaging material 116. It is contemplated that other types of clamps may be used such that interference between the clamp and the web of film is not an issue, and in such a case, the leading end may be released at a different point.

Figure 12:
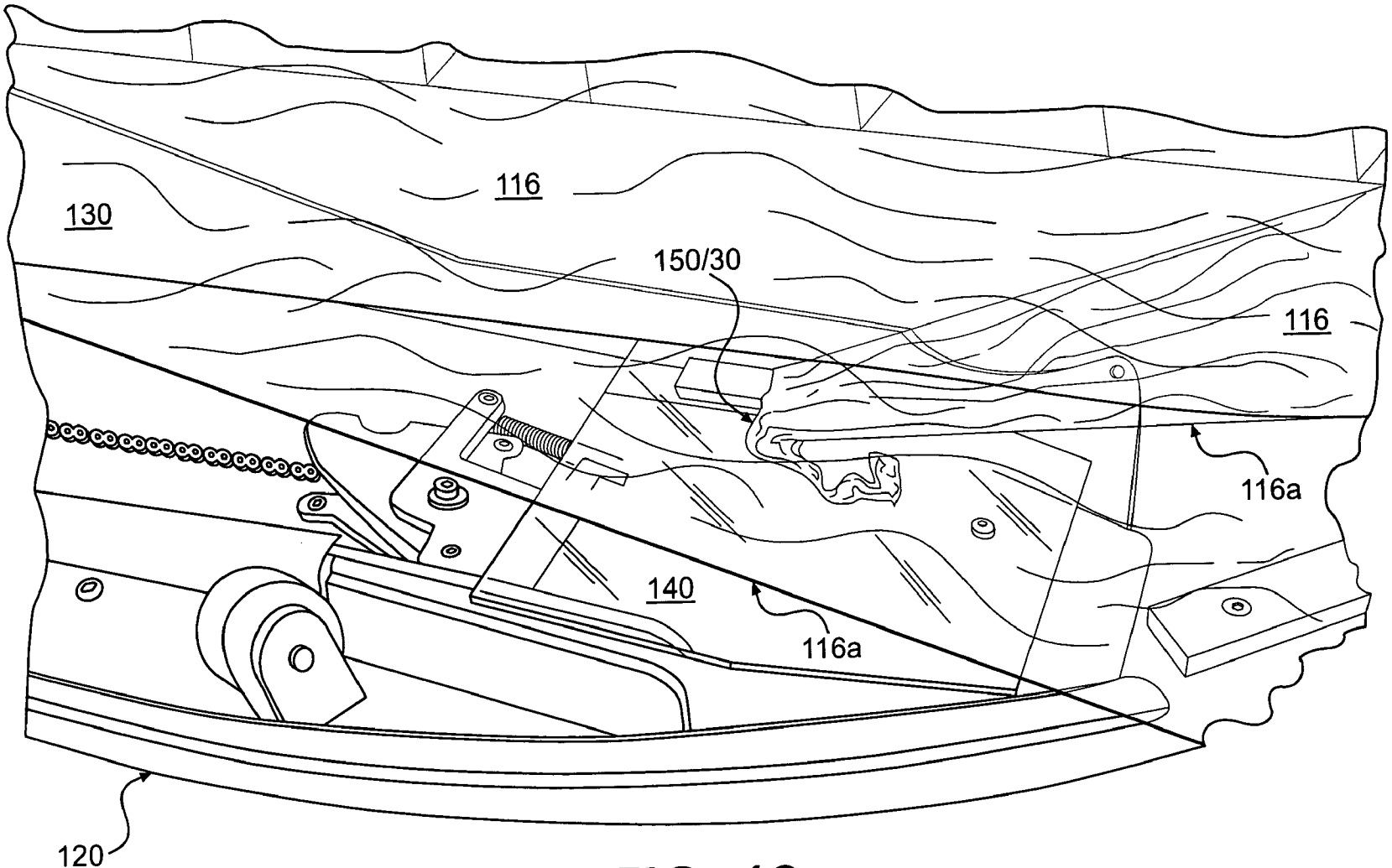
Figure 13:
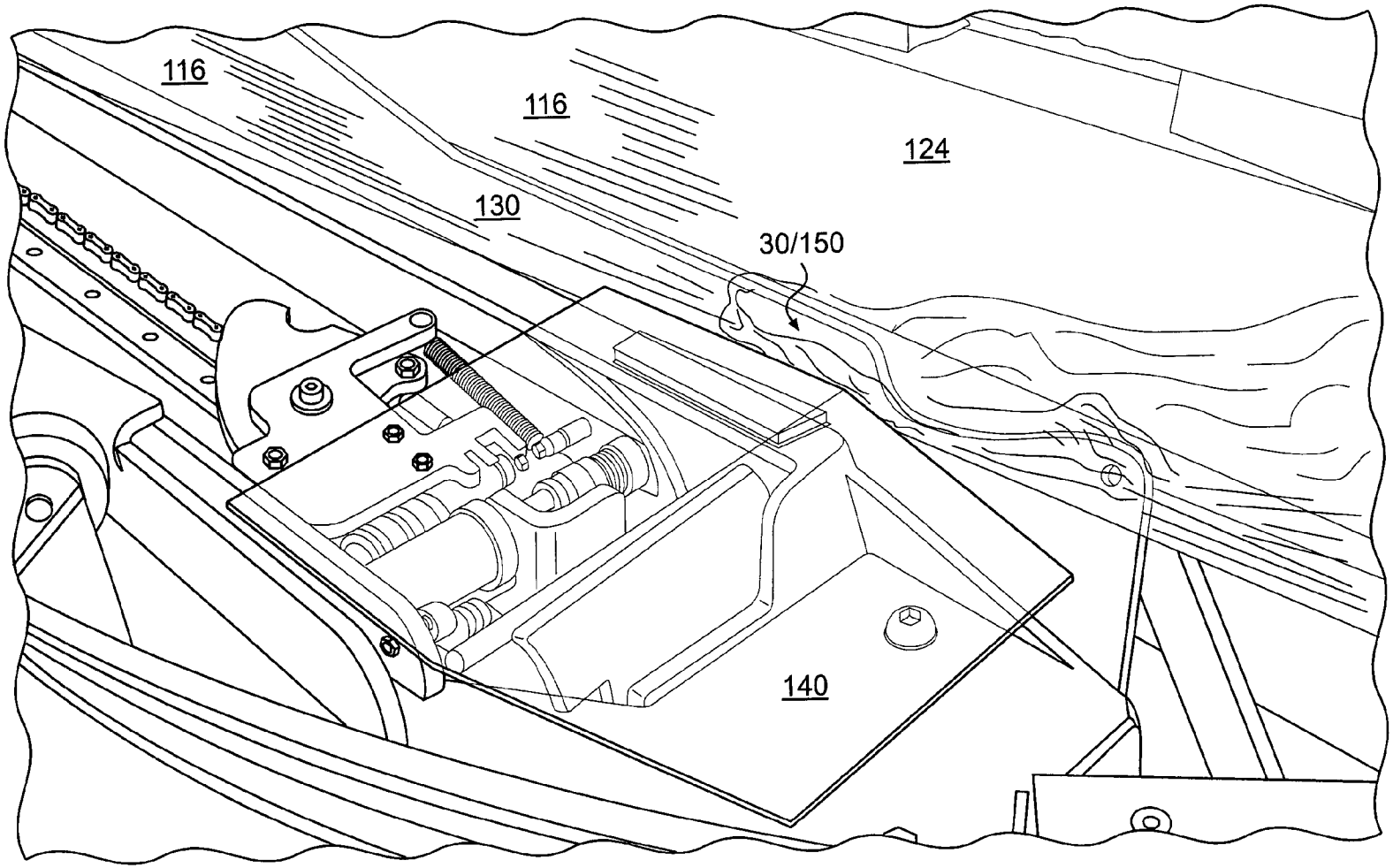

The dispenser 102 then moves down mast 104, continuing to wrap the load 124 as turntable 122 rotates. When dispenser 102 reaches the bottom of mast 104, the bottom surface 116*a* (or roped portion 118) of the web of film 116 slides over tail sweeping plate 140, gathering or "sweeping up" the initial tail of film 150 from plate 140 and securing it to the previous layer of film 116 overwrapping the fixed wrapping structure 130 as shown in FIGS. 12 and 13. The initial tail of film 150 may be overwrapped more than once if so desired. Thus, the initial tail of film 150 is secured between at least two layers of packaging material 116.

After a desired number of layers of film 116 have accumulated, the film clamp 111 is actuated to grasp the packaging material 116 between a corner of the load 124 and the dispenser 102 and to weaken the packaging material between the corner of the load 124 and the dispenser 102 while the turntable continues to rotate slowly, as shown in FIGS. 17 and 18. As can be seen from FIGS. 17 and 18, the knuckle 136 attached to fixed wrapping structure 130 extends outwardly to distend the film path between the corner of the load 124 and the dispenser 102, and is overwrapped by the layers of packaging material 116. As shown in FIGS. 17 and 18, when the film is severed between the corner of the load and the dispenser, the final tail of film 152 snaps backward toward the corner of the load 124 but engages the protruding knuckle 136. The final tail of film 152 adheres to the packaging material 116 overwrapping knuckle 136, such that the final tail of film 152 is secured to the packaging material 116 wrapped around the load 124 as shown in FIG. 19.

Figure 14:
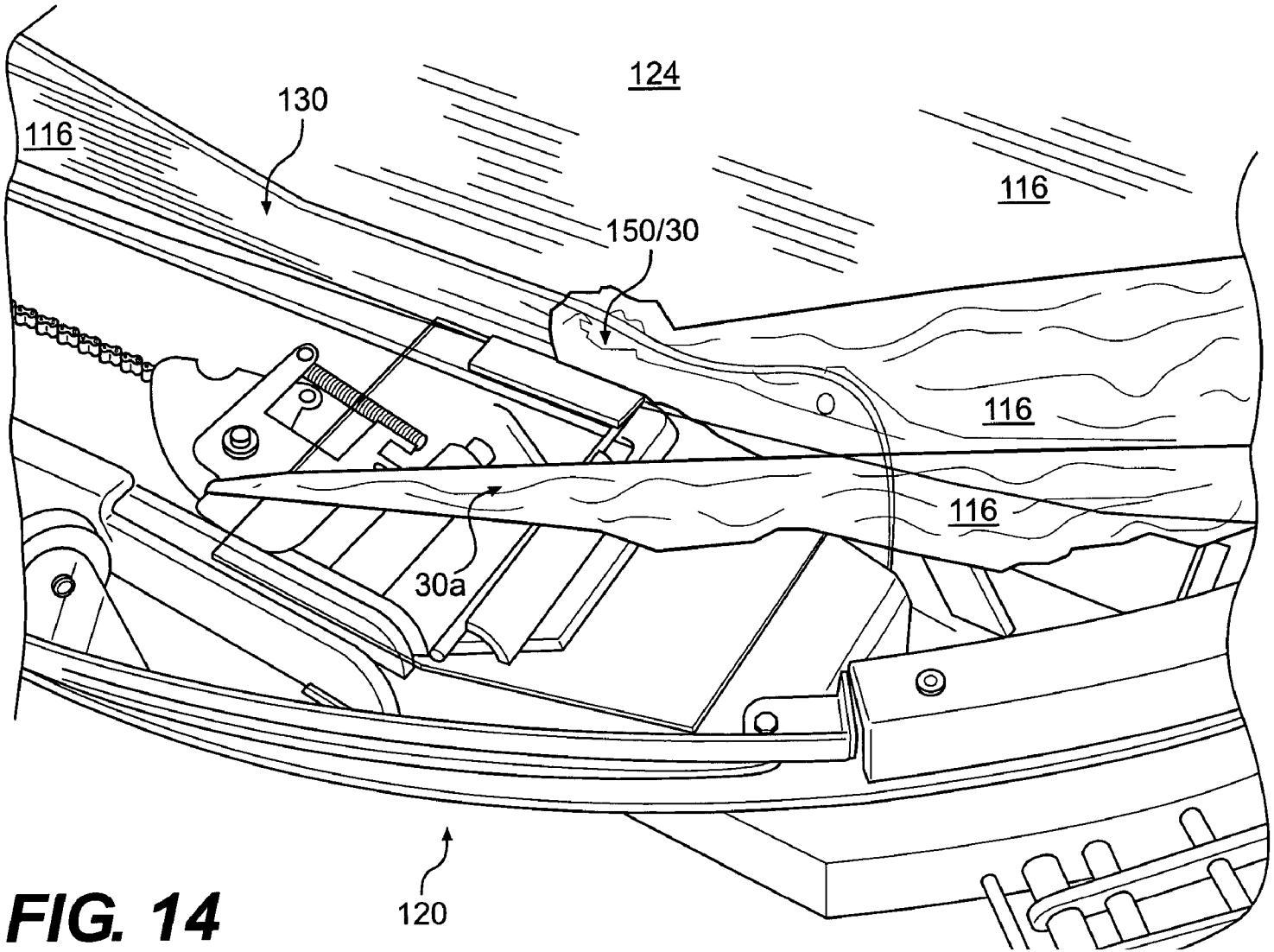
Figure 15:
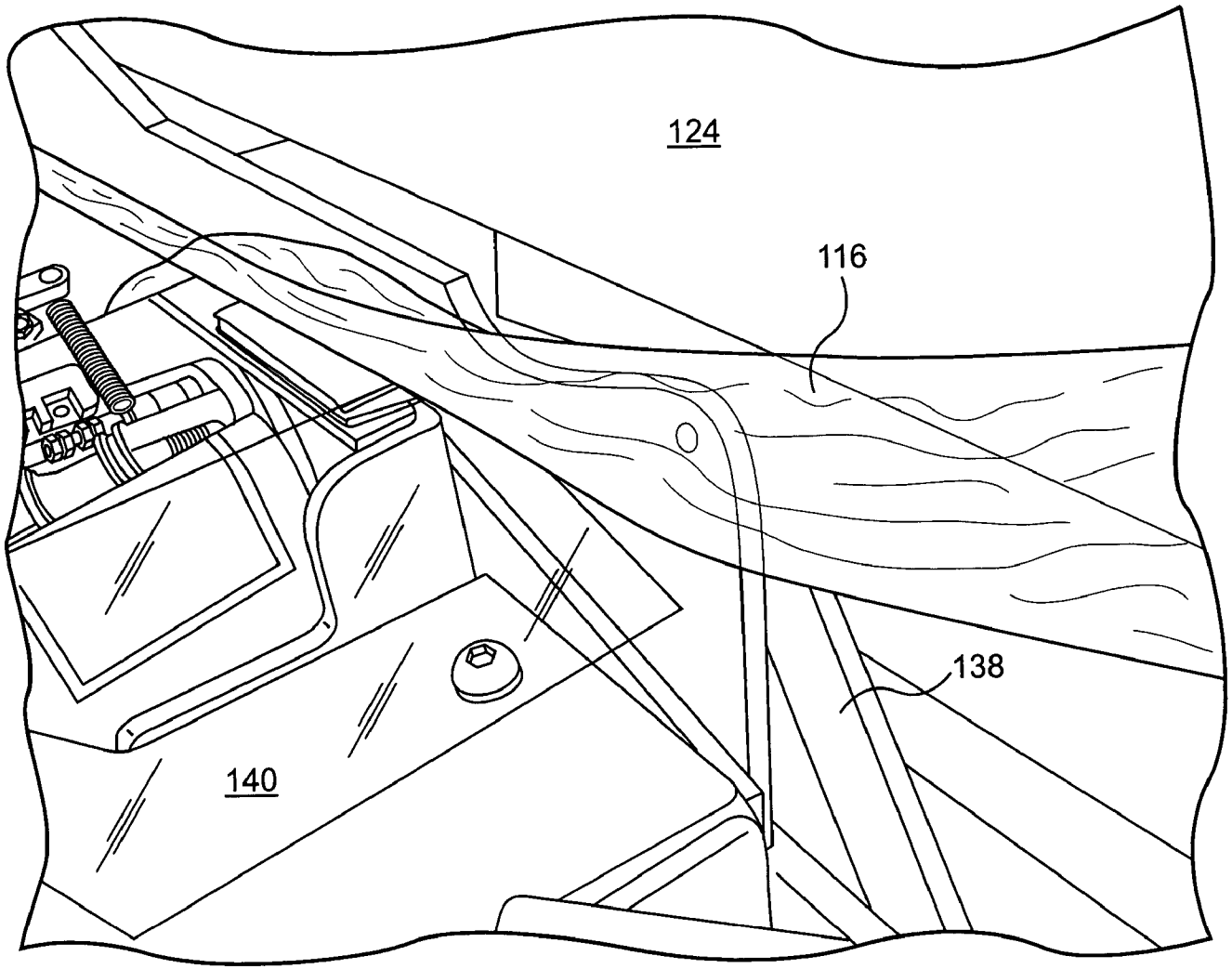
Figure 16:
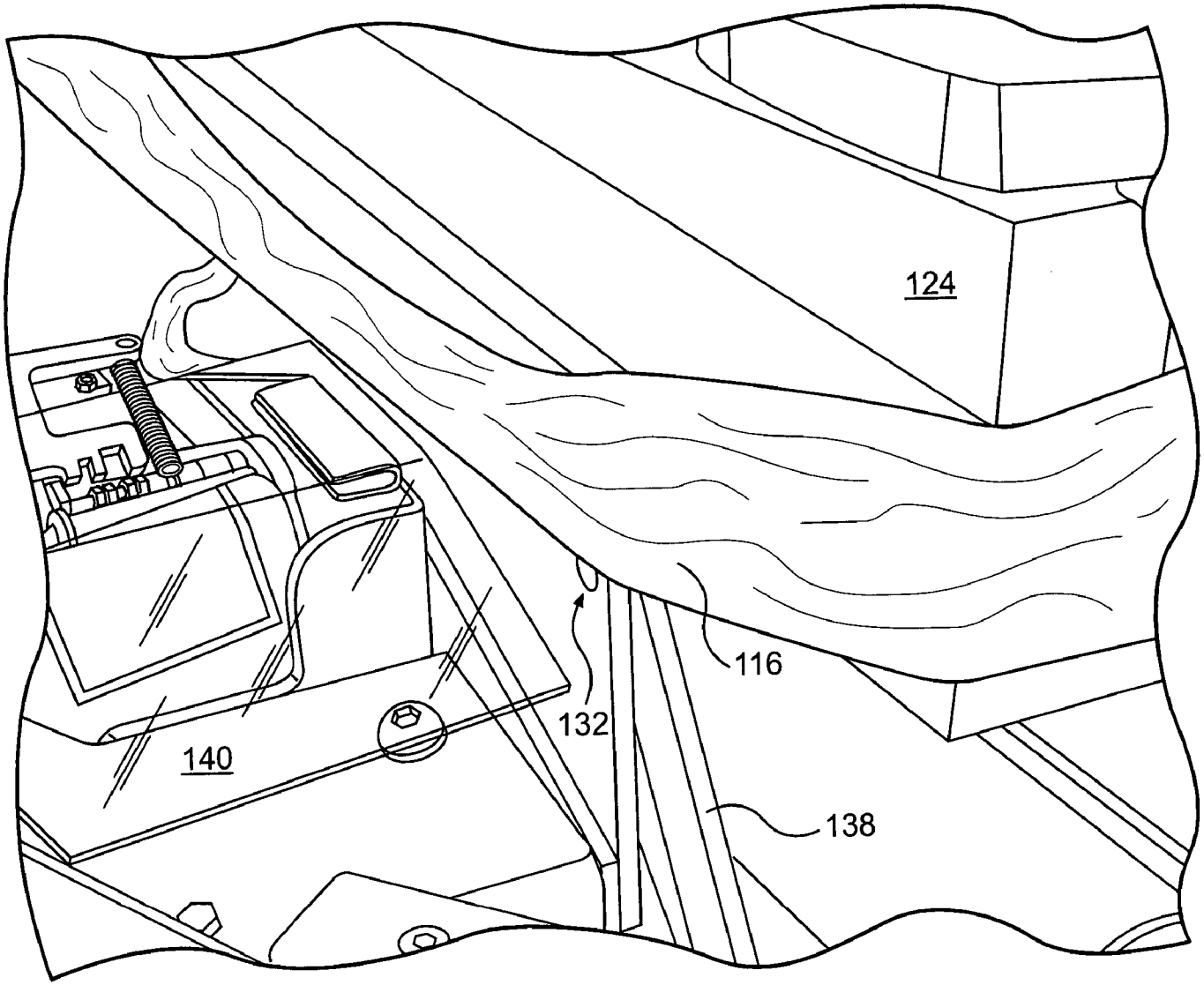

Once the wrapping of the load 124 is complete, as shown in FIG. 14, the load 124 must be removed from turntable 122. As shown in FIGS. 15 and 16, the load 124 may be lifted off of fixed wrapping structure 130. As the load 124 is moved, film release bar 138 allows the film 116 to slide off of proximal corner 132 of fixed wrapping structure 130 and into contact with the load 124. Knuckle 136 similarly allows removal of the film 116 from distal corner 134 of fixed wrapping structure 130. FIG. 20 shows the wrapped load after it has been removed from the turntable 122. As shown in FIG. 20, the initial tail of film 150 and final tail of film 152 are secured to the packaging material 116 on the load 124. Alternatively, if the load 124 is not lifted, it may instead be moved away from the wrapping surface by, for example, conveying. In such an embodiment, the fixed wrapping structure 130 may be tilted on hinges (not shown) to release fixed wrapping structure 130 from between the film 116 and the load 124. As previously discussed, this may be accomplished by a pushing assembly such as the one disclosed in U.S. patent application Ser. No. 09/985,156, filed on Nov. 1, 2001, and incorporated herein by reference. Other suitable alternatives may be used to tilt fixed wrapping structure 130 and push or convey the wrapped load 124 off the turntable 122.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method for wrapping a load with packaging material, comprising:

holding a leading end of a film web extending from a dispenser;

providing relative rotation between the load and the dispenser to wrap the film web around the load;

securing a portion of the leading end of the film web to a fixed wrapping structure prior to releasing the leading end of the film;

releasing the leading end of the film web to lay on a substantially horizontal surface; and securing the released leading end of the film web to the load.

2. The method of claim 1, wherein securing a portion of the leading end of film includes overwrapping a portion of the leading end with the film web to secure the portion of the leading end to the fixed wrapping structure.

3. The method of claim 2, wherein overwrapping the leading end of the film web includes overwrapping the fixed wrapping structure such that the fixed wrapping structure is positioned between the load and the overwrapped film web.

4. The method of claim 1, wherein releasing the leading end of the film web includes actuating a clamp.

5. The method of claim 1, wherein securing the released leading end of the film web includes sweeping up the released leading end off of a substantially horizontal surface.

6. The method of claim 5, wherein sweeping up the released leading end includes capturing the released leading end with the film web as it extends between the load and the dispenser.

7. The method of claim 6, wherein sweeping up the released leading end of the film web further includes overwrapping the fixed wrapping structure such that the fixed wrapping structure and the released leading end are positioned between the load and the overwrapped film.

8. The method of claim 1, wherein providing relative rotation includes rotating a turntable.

9. The method of claim 1, further comprising vertically moving the dispenser on a mast.

10. The method of claim 9, wherein releasing the leading end of film occurs while the dispenser is at a position on the mast approximately level with a top of the load.

11. The method of claim 1, further comprising removing the load from a load wrapping surface.

12. The method of claim 11, wherein removing the load includes lifting the load to release overwrapped film from the fixed wrapping structure.

13. The method of claim 12, wherein removing the load also includes sliding the overwrapped film on a film release bar.

14. The method of claim 11, wherein removing the load includes tilting the fixed wrapping structure.

15. The method of claim 1, wherein securing the released leading end of film includes securing the released end of film between two layers of film.

16. The method of claim 1, wherein securing the released leading end of film includes capturing the released leading end with the film web as it extends between the load and the dispenser.

17. A method of securing an initial tail of packaging material to a load while wrapping the load with packaging material, comprising:

holding a leading end of packaging material;

wrapping the packaging material around a fixed wrapping structure, at least a portion of the leading end of the packaging material that is being held, and the load;

releasing the overwrapped leading end of packaging material; and securing the released leading end of packaging material between two layers of packaging material.

18. The method of claim 17, wherein holding a leading end of the packaging material includes holding the leading end with a clamp.

19. The method of claim 17, wherein wrapping the packaging material includes providing relative rotation between a packaging material dispenser and the load.

20. The method of claim 19, wherein providing relative rotation includes rotating a turntable supporting the load and the fixed wrapping structure.

21. The method of claim 17, wherein securing the released leading end of packaging material includes capturing the released end with a web of the packaging material.

22. The method of claim 21, wherein securing the released leading end of packaging material further includes securing the released end to the fixed wrapping structure with the web of packaging material.

23. A method of securing a final tail of film to a load while wrapping the load with a film web, comprising:

positioning a load on a load support surface adjacent to a fixed wrapping structure;

dispensing a film web from a dispenser;

providing relative rotation between the load and the dispenser to wrap the film web around the load and the fixed wrapping structure;

distending a film path extending between a corner of the load and the dispenser with a portion of the fixed wrapping structure;

severing the film between a corner of the load and the dispenser, wherein severing the film includes weakening the film between the fixed wrapping structure and the dispenser, and providing relative rotation between the dispenser and the load to tear the weakened film; and securing a severed end of film to the load.

24. The method of claim 23, wherein providing relative rotation between the load and the dispenser includes wrapping the film web over the fixed wrapping structure.

25. The method of claim 24, wherein securing the severed end of film to the load includes engaging the severed end of film with a protrusion of the fixed wrapping structure.

26. The method of claim 23, wherein securing the severed end of film includes engaging the severed end of film as it snaps toward the corner of the load after tearing.

27. The method of claim 23, further comprising, prior to providing relative rotation, holding a leading end of the film web extending from the dispenser.

28. The method of claim 27, further comprising securing a portion of the leading end of the film web to the fixed wrapping structure prior to releasing the leading end of the film.

29. The method of claim 28, further comprising releasing the leading end of the film web.

30. The method of claim 29, further comprising securing the released leading end of the film to the load.

31. The method of claim 23, further comprising:

holding a leading end of the film web extending from the dispenser;

releasing the leading end of the film web; and securing the released leading end of the film to the load.

32. The method of claim 31, wherein securing the released leading end of the film includes securing the released leading end between two layers of film.

33. An apparatus for securing an initial tail of film to a load while wrapping the load with packaging material, comprising:

means for holding a leading end of packaging material;

means for providing relative rotation between the load and a dispenser to dispense packaging material;

means for securing a held leading end of packaging material; and means for securing a released leading end of packaging material between two layers of packaging material.

34. The apparatus of claim 33, wherein the means for providing relative rotation includes a turntable.

35. The apparatus of claim 33, wherein the means for holding the leading end of packaging material includes a clamp.

36. The apparatus of claim 33, wherein the means for securing the held leading end of packaging material includes a fixed wrapping structure.

37. The apparatus of claim 36, wherein the fixed wrapping structure is positioned between the means for holding the leading end of packaging material and a load support surface.

38. The apparatus of claim 36, wherein the means for securing the held leading end of packaging material further includes a layer of packaging material.

39. The apparatus of claim 36, wherein the fixed wrapping structure includes a proximal end portion, a distal end portion, and a top surface extending between the proximal and distal end portions.

40. The apparatus of claim 39, wherein the fixed wrapping structure is positioned to permit the held leading end to extend over the top surface of the fixed wrapping structure between the means for holding the leading end and a corner of the load.

41. The apparatus of claim 33, wherein the means for securing the released end of packaging material includes a substantially horizontal surface.

42. The apparatus of claim 41, wherein the substantially horizontal surface is a plate.

43. The apparatus of claim 33, wherein the means for securing the released end of packaging material includes a web of film extending between the dispenser and a portion of the means for securing the held end of packaging material.

44. The apparatus of claim 43, wherein the means for securing the held end of packaging material includes a fixed wrapping structure.

45. The apparatus of claim 44, wherein the web of film extends between the dispenser and a distal end portion of the fixed wrapping structure.

46. An apparatus for securing a final tail of film to a load while wrapping the load with a film web, comprising:

a load support surface;

a film dispenser;

means for providing relative rotation between the load and the dispenser to wrap the film web around the load and a fixed wrapping structure;

means for distending a film path extending between a corner of the load and the dispenser, the means for distending including a protrusion that extends from the fixed wrapping structure into the film path;

means for severing the film along the film path; and means for securing a severed end of film to the load.

47. The apparatus of claim 46, wherein the means for providing relative rotation is a turntable.

48. The apparatus of claim 46, wherein the means for distending the film path includes a portion of the fixed wrapping structure, wherein the fixed wrapping structure is positioned adjacent the load support surface.

49. The apparatus of claim 48, further comprising means for holding a leading end of the film.

50. The apparatus of claim 49, wherein the fixed wrapping structure is positioned between the load support surface and the means for holding the leading end of the film.

51. The apparatus of claim 49, further comprising means for securing a released leading end of the film to the load.

52. An apparatus for securing an initial tail of film and a final tail of film to a load while wrapping the load with a film web, comprising:

means for holding a leading end of a film web;

means for providing relative rotation between the load and a dispenser to dispense the film web;

means for securing the held leading end of the film web;

means for securing a released leading end of the film web between two layers of film;

means for distending a film path extending between a corner of the load and the dispenser;

means for severing the film web along the film path; and means for securing a severed end of film to the load.

53. An apparatus for securing a final tail of film to a load while wrapping the load with a film web, comprising:

a load support surface;

a film dispenser for dispensing film;

means for holding a leading end of the film;

means for providing relative rotation between the load and the dispenser to wrap the film web around the load and a fixed wrapping structure, wherein the fixed wrapping structure is positioned between the load support surface and the means for holding the leading end of the film;

means for distending a film path extending between a corner of the load and the dispenser, wherein the means for distending includes a portion of the fixed wrapping structure;

means for severing the film along the film path; and means for securing a severed end of film to the load.

* * * * *